US007777594B2

(12) United States Patent
Eleftheriades

(10) Patent No.: US 7,777,594 B2
(45) Date of Patent: Aug. 17, 2010

(54) NEGATIVE-REFRACTION METAMATERIALS USING CONTINUOUS METALLIC GRIDS OVER GROUND FOR CONTROLLING AND GUIDING ELECTROMAGNETIC RADIATION

(75) Inventor: George V. Eleftheriades, Scarborough (CA)

(73) Assignee: Ontario Centres of Excellence Inc., Ottawa (CA)

( * ) Notice: Subject to any disclaimer, the term of this patent is extended or adjusted under 35 U.S.C. 154(b) by 8 days.

(21) Appl. No.: 11/659,768

(22) PCT Filed: Aug. 9, 2005

(86) PCT No.: PCT/CA2005/001224

§ 371 (c)(1),
(2), (4) Date: Dec. 17, 2007

(87) PCT Pub. No.: WO2006/015478

PCT Pub. Date: Feb. 16, 2006

(65) Prior Publication Data

US 2008/0204164 A1 Aug. 28, 2008

Related U.S. Application Data

(60) Provisional application No. 60/599,551, filed on Aug. 9, 2004.

(51) Int. Cl.
*H01P 5/12* (2006.01)

(52) U.S. Cl. ..... 333/134; 333/126; 333/129; 333/132

(58) Field of Classification Search ..... 333/126–129, 333/132, 134, 136
See application file for complete search history.

(56) References Cited

U.S. PATENT DOCUMENTS

| | | | | |
|---|---|---|---|---|
| 4,983,865 | A * | 1/1991 | Ho et al. | 327/404 |
| 5,446,424 | A * | 8/1995 | Pierro | 333/104 |
| 6,265,953 | B1 * | 7/2001 | Romano | 333/101 |
| 6,859,114 | B2 * | 2/2005 | Eleftheriades et al. | 333/156 |
| 6,933,812 | B2 * | 8/2005 | Sarabandi et al. | 333/219 |
| 6,998,935 | B2 * | 2/2006 | Jain et al. | 333/104 |
| 7,385,455 | B2 * | 6/2008 | Fischer | 333/12 |
| 2008/0204164 | A1 * | 8/2008 | Eleftheriades | 333/134 |

OTHER PUBLICATIONS

International Preliminary Report on Patentability for International Application No. PCT/CA2005/001224, dated Feb. 13, 2007.

(Continued)

*Primary Examiner*—Robert Pascal
*Assistant Examiner*—Kimberly E Glenn
(74) *Attorney, Agent, or Firm*—Marshall, Gerstein & Borun LLP; Richard M. LaBarge

(57) ABSTRACT

For the cost effective implementation of negative-index refraction, an anisotropic hyperbolic planar metamaterial is provided. The material has a first set of substantially parallel, unloaded and coplanar transmission lines that are spaced with a periodicity dy. It has a second set of substantially parallel, unloaded and coplanar transmission lines that are spaced with a periodicity dx and are coplanar and substantially orthogonal with the first set of transmission lines. The periodicities of the first set and second set of transmission lines are governed by the relationship $\beta x(fr)dx+\beta y(fr)dy=2\pi$, where: $\beta x$ and $\beta y$ are the intrinsic propagation constants of electromagnetic waves of frequency fr propagating along the first and second set of transmission lines, respectively.

10 Claims, 28 Drawing Sheets

OTHER PUBLICATIONS

Written Opinion for International Application No. PCT/CA2005/001224, dated Feb. 13, 2007.

Grbic et la., "Overcoming the Diffraction Limit with a Planar Left-Handed Transmission-Line Lens," *Phys. Rev. Lett.,* 92(11):117403 (2004).

* cited by examiner (a)

(Prior Art)

(b)

(a) 2 GHz (Off-resonance)

(b) 5.95 GHz (Below Resonance)

(c) 6.0 GHz (Resonance)

(d) 6.05 GHz (Above Resonance)

(a) K-Space (b) Real Space (a)

(b)

(c)

(a) Simulation (b) Experiment

BWTL Grid (a)

FWTL Grid (b)

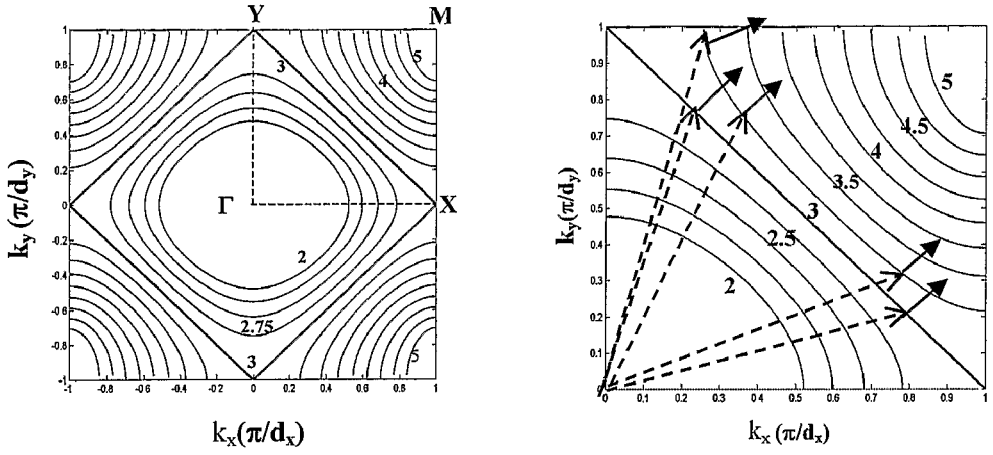
(a) (b)
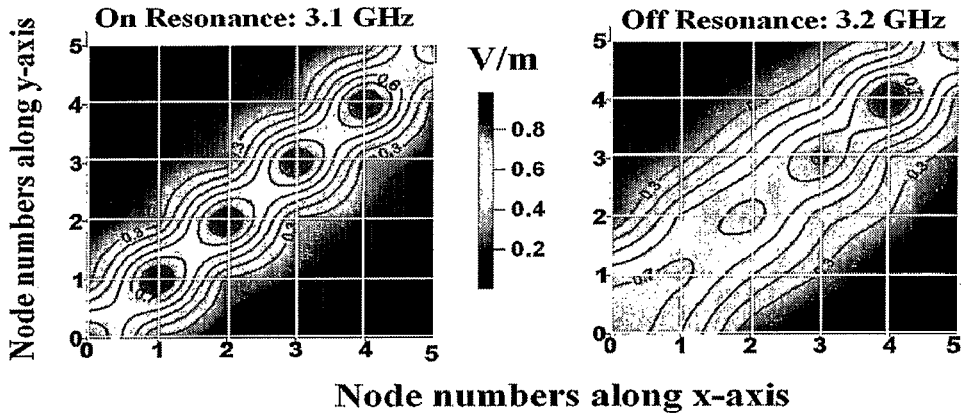
(c)
Fig. 16
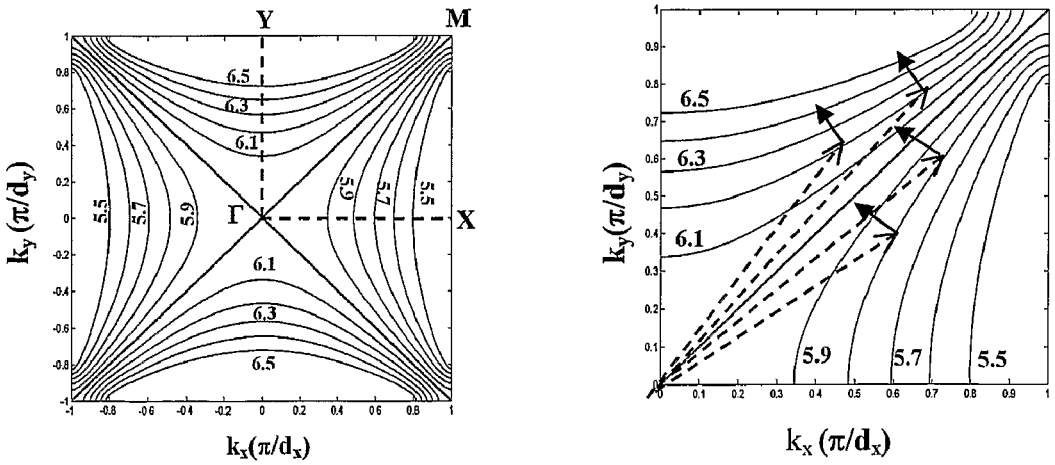

(a) (b)

(c)

(a) Beam-splitter in real space (b) Beam-splitter in k-space (a) Diplexer in real space (b) Diplexer in k-space

NEGATIVE-REFRACTION METAMATERIALS USING CONTINUOUS METALLIC GRIDS OVER GROUND FOR CONTROLLING AND GUIDING ELECTROMAGNETIC RADIATION

FIELD OF THE INVENTION

The present invention relates generally to the control and guidance of electromagnetic radiation and in particular to isotropic "left-handed" and anisotropic "hyperbolic" negative-refraction metamaterials for controlling and guiding electromagnetic radiation and to applications therefor.

BACKGROUND OF THE INVENTION

The concept of a negative index of refraction, originally proposed by Veselago in the 1960s, suggested the possibility of materials in which the permittivity and permeability could be made simultaneously negative. Veselago termed these left-handed media (LHM), because the vectors E, H, and k would form a left-handed triplet instead of a right-handed triplet, as is the case in conventional, right-handed media (RHM). In such a material the phase velocity and Poynting vector are antiparallel. Recently, novel three-dimensional (3D) electromagnetic materials have successfully demonstrated negative refraction of two-dimensional (2D) electromagnetic waves by synthesizing a negative refractive index. These artificial dielectrics (metamaterials) consist of loosely coupled unit cells composed of thin wire strips and split-ring resonators to synthesize negative permittivity and permeability, respectively. In these metamaterials, the choice of operating frequency is restricted to the region of resonance, which results in a highly dispersive, narrowband behaviour with strong associated absorption losses.

Other structures with magnetic properties to refract electromagnetic radiation at negative angles have also been considered. For example, Inteniational PCT Application Publication No. WO 00/41270 discloses a structure that exhibits magnetic properties when it receives incident electromagnetic radiation. The structure includes an array of capacitive elements, each of which is smaller, and preferably much smaller, than the wavelength of the incident electromagnetic radiation. Each capacitive element has a low-resistance conducting path associated with it and is such that a magnetic component of the incident electromagnetic radiation induces an electrical current to flow around a path and through the associated capacitive element. The creation of the internal magnetic fields generated by the flow of the induced electrical current gives rise to the structure's magnetic properties.

International PCT Application Publication No. WO 02/03500 discloses a microstructured magnetic material having a magnetic permeability of negative value but unity magnitude over a particular radio frequency range.

Furthermore, in all the previous structures described, the unit cells are not physically connected. This further restricts their useful operating bandwidths.

U.S. Patent Application Publication No. US-2004-0066251-A1 discloses improved left-handed metamaterials exhibiting negative refractive indices. The left-handed metamaterials incorporate transmission lines loaded with discrete components. Fabricating such a metamaterial is more costly and difficult than fabricating a metamaterial with unloaded i.e. continuous transmission lines. Moreover due to the discrete embedded elements it is challenging to extend their operating frequencies well into the microwave or millimetre-wave spectra.

Although metamaterials exhibiting negative refractive indices exist, improved metamaterials that are easier and less costly to manufacture are desired. It is therefore an object of the present invention to provide novel isotropic "left-handed" and anisotropic "hyperbolic" negative-refraction metamaterials for controlling and guiding electromagnetic radiation.

SUMMARY OF THE INVENTION

According to one aspect of the present invention there is provided an anisotropic hyperbolic planar metamaterial comprising a first set of substantially parallel, unloaded and coplanar transmission lines, the transmission lines being spaced with a periodicity $d_y$ and a second set of substantially parallel, unloaded and coplanar transmission lines, the transmission lines being spaced with a periodicity $d_x$. The second set of transmission lines is coplanar and substantially orthogonal with the first set of transmission lines. The periodicities of the first set and second set of transmission lines are governed by the relationship:

$$\beta_x(f_r)d_x+\beta_y(f_r)d_y=2\pi$$

where:

$\beta_x$ and $\beta_y$ are the intrinsic propagation constants of electromagnetic waves of frequency $f_r$ propagating along the first and second set of transmission lines, respectively.

According to another aspect of the present invention there is provided an isotropic planar metamaterial comprising a first set of substantially parallel, unloaded and coplanar transmission lines, the transmission lines being spaced with a periodicity d and a second set of substantially parallel, unloaded and coplanar transmission lines, the transmission lines being spaced with a periodicity d. The second set of transmission lines is coplanar and substantially orthogonal with the first set of transmission lines. The periodicity of the first set and second set of transmission lines being governed by the relationships:

$$d=\lambda-\delta \text{ and } \beta=2\pi/\lambda$$

where:

$\beta$ is the intrinsic propagation constant of electromagnetic waves of wavelengths $\lambda$ on the transmission lines and $\delta$ is a differential length such that $\delta<\lambda/2$.

As will be appreciated, since the metamaterials are fabricated from arrays or grids of unit cells that include unloaded transmission lines, the metamaterials are easier and less costly to manufacture. Also, metamaterials formed of the unit cells are scalable across a wide range of frequencies such as for example from microwave to millimetre-wave frequencies.

BRIEF DESCRIPTION OF THE DRAWINGS

Embodiments of the present invention will now be described more fully with reference to the accompanying drawings in which:

FIG. 16 shows: (a) 2 GHz to 5 GHz EFSs in the first band of propagation drawn in the first Brillouin zone; The numbers indicate the frequencies in GHz and the EFSs are 0.25 GHz apart; and (b) A zoom-in on the first quadrant of the EFS; The dotted arrows show the k-vectors and the small solid arrows indicate the direction of the group velocity; On the 3 G EFS, all the vg vectors point in the same direction; However, for 3.25 GHz, only the vg vectors on the mid flat part of the contour have the same directions; and (c) Simulated normalized electric field intensity plot superimposed on the schematic diagram of the 5×5 cell metallic grid, fed at node (0,0), for frequencies 3.1 GHz and 3.2 GHz, showing rectangular resonant mode propagation along the diagonal;

DETAILED DESCRIPTION OF THE EMBODIMENTS

The present invention relates generally to metamaterials that support negative refraction of electromagnetic waves. Such metamaterials inherently support two-dimensional (2D) wave propagation, which is desirable for antennas, antenna beam formers, planar spectrum analyzers, filters, compact radio frequency (RF)/microwave lenses and antennas, phase compensators, antenna-integrated multiplexers, near-field imaging and sensing devices, and other microwave circuit applications.

Figure 1:
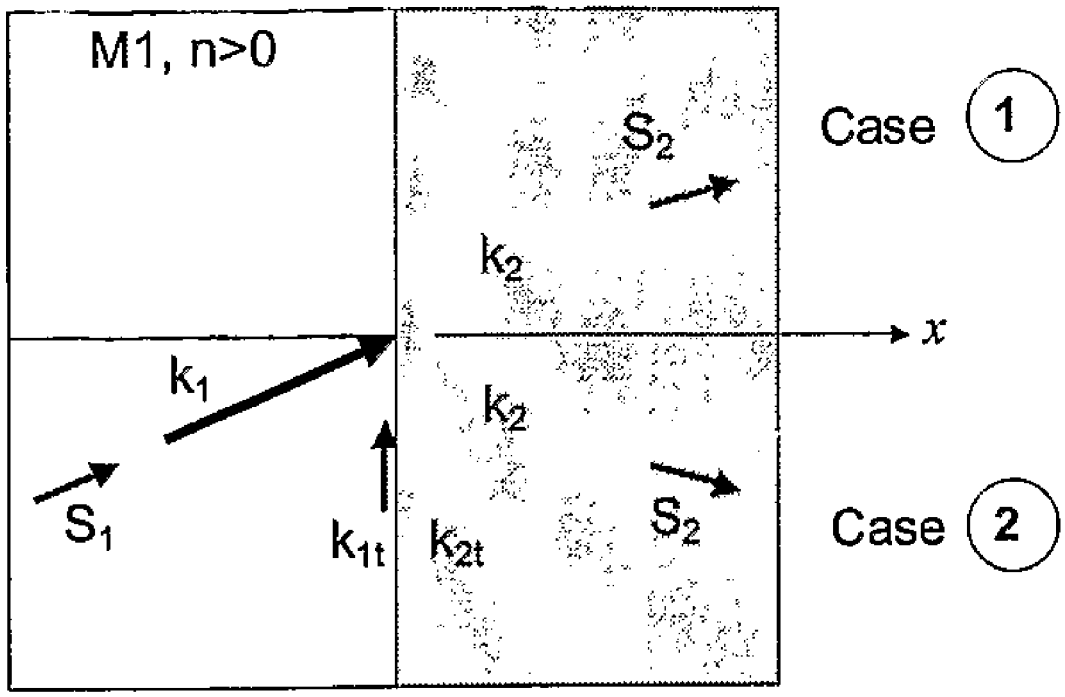
FIG. 1 shows phase matching at an interface between a right-handed material (RHM) and a generic material i.e. a right-handed material or a left-handed material.

To illustrate the concept of negative refraction, consider phase-matching at the interface between a right-handed medium M1 and another generic medium M2, as shown in FIG. 1. The sign of the index of refraction of medium M2 is not a concern. Consider an incident plane wave in medium M1 with a wave vector $k_1$ (i.e. such that the x-component of $k_1$ is positive). A refracted wave with a wave vector $k_2$ is then established in medium M2 such that the tangential wave vector components $k_{1t}$ and $k_{2t}$ are equal across the interface. This is the basis for Snell's Law, and it permits two scenarios for the orientation of $k_2$, represented as Case 1 and Case 2 in FIG. 1. The conservation of energy requires that the normal components of the Poynting vectors $S_1$ and $S_2$ remain in the positive x-direction through both media. If the medium M2 is a conventional right-handed medium (RHM), then refraction occurs as illustrated by Case 1. However, if medium M2 is a medium supporting propagating backward waves (i.e. a left-handed medium (LHM)), it is implied that power is propagated along the direction of phase advance, which requires that $k_2$ and $S_2$ be antiparallel. Consequently, the direction of $k_2$ is specified uniquely for backward-wave structures as illustrated by Case 2. Under such conditions, power is refracted through an effectively negative angle, which implies a negative index of refraction.

Aforementioned U.S. Patent Application Publication No. US-2004-0066251-A1 (the "251 Application"), the content of which is hereby incorporated by reference, discloses a hyperbolic metamaterial formed of a grid of unit cells, with each unit cell including discretely loaded transmission lines, referred to hereinafter as "Balmain" metamaterial. A unit cell of the Balmain metamaterial disclosed in the '251 application is shown in FIG. 2*a*. As can be seen, the unit cell comprises orthogonally positioned inductors and capacitors that load a host transmission line network. To simplify the diagram, the ground conductors are not shown. The periodicity 'd' of the inductors and the capacitors is very small when compared to the operational wavelength, which permits to define effective permittivity and permeability parameters. When the unit cells are arranged to form a two-dimensional (2D) transmission line (TL) grid, the resulting 2D TL grid has material parameters with opposite signs along the x- and y-axes. When the 2D TL grid is excited by a voltage source to ground at the L-C resonant frequency, strong fields, or in plasma terminology, resonance cones are produced along the grid's diagonal directions. To observe negative refraction and focusing of the resonance cones, the excited 2D TL grid is interfaced with a transposed 2D TL grid in which the positions of inductors and capacitors are interchanged.

Although the Balmain metamaterial is effective and exhibits a negative refractive index, it is difficult and expensive to manufacture as a result of the use of loaded transmission lines i.e. transmission lines including inductors and capacitors arranged periodically. To overcome these disadvantages associated with the Balmain metamaterial, the present invention provides a hyperbolic metamaterial, exhibiting a negative index of refraction that avoids the use of loaded transmission lines as will now be described.

Turning now to FIG. 2*b*, the unit cell of a hyperbolic metamaterial in accordance with the present invention is shown. As can be seen, the unit cell comprises first and second sets of transmission lines. The transmission lines of each set are substantially parallel, unloaded and coplanar. The transmission lines of the first set are coplanar with and substantially orthogonal to the transmission lines of the second set. A resonant condition at a frequency $f_r$ is attained in the unit cell by using transmission line segments of unequal lengths $d_x$ and $d_y$, satisfying the following condition:

$$\beta_x(f_r)d_x+\beta_y(f_r)d_y=2\pi \quad (1)$$

where:

$\beta_x$ and $\beta_y$ are the intrinsic propagation constants on the transmission lines along the x and y directions respectively.

Condition (1) results in constructive wave interference along the diagonal direction as will be described. As will be appreciated, since the unit cell does not require any passive loading elements, metamaterials formed of these unit cells are easier and less expensive to manufacture as compared to Balmain metamaterial. Also, metamaterials formed of these unit cells are scalable from microwave to millimetre-wave frequencies.

Figure 2:
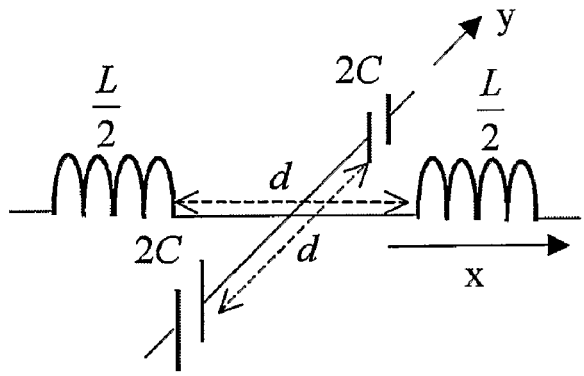
FIG. 2 shows (a) a prior unit cell of a hyperbolic metamaterial including transmission lines loaded with inductors and capacitors and (b) a unit cell of a hyperbolic metamaterial in accordance with the present invention including unloaded transmission lines.
Figure 2:
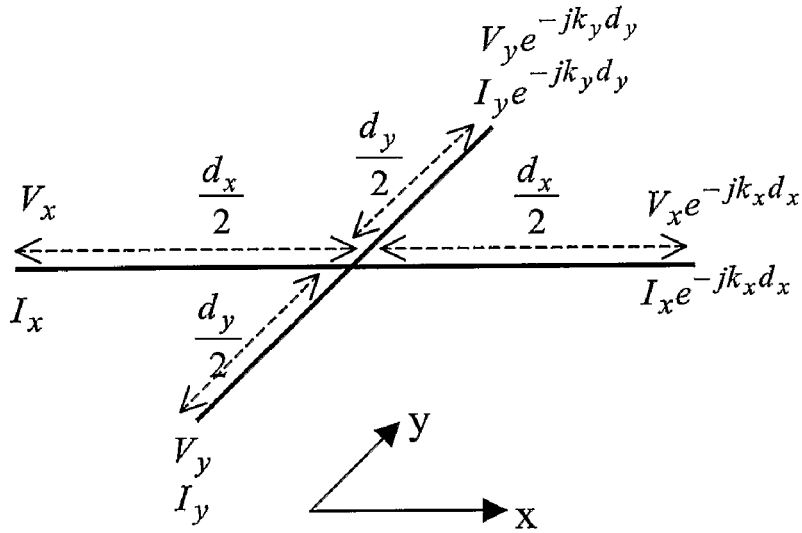
Figure 3:
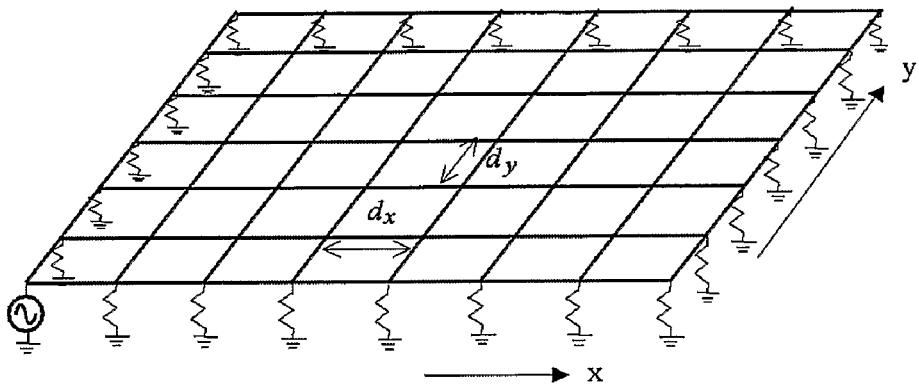
FIG. 3 shows a two-dimensional (2D) transmission line (TL) anisotropic metamaterial including a grid of unit cells of the type of FIG. 2*b* with corner excitation and resistive terminations at the edges.

FIG. 3 shows a 2D anisotropic periodic metamaterial formed of a grid of unit cells of the type shown in FIG. 2*b*. Since the periodicities $d_x$ and $d_y$ along the x- and y-axes of the 2D anisotropic periodic metamaterial are on the order of half wavelength, effective permittivity and permeability parameters cannot be defined. However, an effective refractive index, based on the Bloch propagation constant, can be defined.

The resonance cone phenomenon in anisotropic plasmas as well as in the metamaterial of FIG. 3 is attributed to the underlying hyperbolic spatial dispersion characteristics. The theory of 2D infinite periodic structures in A. Grbic and G. V. Eleftheriades, "Periodic analysis of a 2-D negative refractive index transmission line structure", *IEEE Transactions on Antennas and Propagation: Special Issue on Metamaterials*, vol. 51, no. 10, pp. 2604-2611, October 2003, the content of which is hereby incorporated by reference, is applied to derive the dispersion equation of the metamaterial. Looking at the unit cell of FIG. 2*b*, the Bloch-Floquet theorem implies that the voltages and currents on the terminals of the unit cell can differ only by propagation factors $k_xd_x$ and $k_yd_y$, where $k_x$ and $k_y$ are the x and y components of the 2D Bloch propagation constant of the unit cell. Periodic transmission-line analysis gives the following matrix equation that relates the node voltages and currents at the terminals of the unit cell:

$$\begin{pmatrix} 1-e^{-jk_xd_x} & -\frac{B_x}{D_x}(1+e^{-jk_xd_x}) & 0 & 0 \\ 0 & 0 & 1-e^{-jk_yd_y} & -\frac{B_y}{D_y}(1+e^{-jk_yd_y}) \\ A_xe^{-jk_xd_x} & B_xe^{-jk_xd_x} & -A_ye^{-jk_yd_y} & -B_ye^{-jk_yd_y} \\ -C_x(1+e^{-jk_xd_x}) & A_x(1-e^{-jk_xd_x}) & -C_y(1+e^{-jk_yd_y}) & A_y(1-e^{-jk_yd_y}) \end{pmatrix} \begin{pmatrix} V_x \\ I_x \\ V_y \\ I_y \end{pmatrix} = \begin{pmatrix} 0 \\ 0 \\ 0 \\ 0 \end{pmatrix}. \quad (2)$$

The parameters $A_n$, $B_n$, $C_n$, and $D_n$, (n=x,y), are the elements of the forward transmission matrix of the transmission lines (assumed lossless) forming the unit cell of FIG. 2*b*:

$$\begin{pmatrix} A_n & B_n \\ C_n & D_n \end{pmatrix} = \begin{pmatrix} \cos\left(\frac{\beta_n d_n}{2}\right) & jZ_{on}\sin\left(\frac{\beta_n d_n}{2}\right) \\ jY_{on}\sin\left(\frac{\beta_n d_n}{2}\right) & \cos\left(\frac{\beta_n d_n}{2}\right) \end{pmatrix}, \quad (3)$$

where:

n=x or y; and $Z_{on}$ and $Y_{on}$, are the intrinsic TL characteristic impedance and admittance in the x or y directions, respectively.

For a non-trivial solution, the determinant of matrix equation (2) should vanish. This yields the following characteristic fall dispersion equation:

$$\sin(\beta_x d_x)\cos(k_y d_y)+\sin(\beta_y d_y)\cos(k_x d_x)=\sin(\beta_x d_x+\beta_y d_y) \quad (4)$$

A perturbation analysis of equation (4) reveals a great deal of information about the unit cell grid arrangement of the metamaterial. Let $\beta_x=\beta_y=\beta=2\pi f/c$ and $\delta$ represent a symmetric length differential with respect to the half-resonant wavelength $\lambda_r/2(\lambda_r=c/f_r)$ in the x- and y-directions:

$$d_x = \frac{\lambda_r}{2} + \delta \quad (5)$$

$$d_y = \frac{\lambda_r}{2} - \delta \quad (6)$$

Furthermore let $\Delta\omega$ be a frequency perturbation with respect to the resonant frequency $\omega_r$. Under these conditions, the intrinsic phase shifts along the two orthogonal x- and y-directions become:

$$\beta_x d_x = \pi + 2\pi\frac{\delta}{\lambda_r} + \pi\frac{\Delta\omega}{\omega_r} \quad (7)$$

$$\beta_y d_y = \pi - 2\pi\frac{\delta}{\lambda_r} + \pi\frac{\Delta\omega}{\omega_r} \quad (8)$$

Substituting equations (7) and (8) into the full dispersion equation (4), yields:

$$\left(2\frac{\delta}{\lambda_r} - \frac{\Delta\omega}{\omega_r}\right)\cos(k_x d_x) - \left(2\frac{\delta}{\lambda_r} + \frac{\Delta\omega}{\omega_r}\right)\cos(k_y d_y) = 2\frac{\Delta\omega}{\omega_r} \quad (9)$$

At resonance, condition (1) is satisfied and $\Delta\omega=0$ so that the right-hand sides of dispersion equations (4) and (9) vanish. Under such resonance conditions, dispersion equation (9) yields $k_xd_x=\pm k_yd_y$ which corresponds to preferential propagation along the diagonal directions of the grid and explains the formation of resonance cones. This justifies equation (1) as the resonant condition which leads to the strong formation of the resonance cones. Dispersion equation (9) can be further expanded about the $\Gamma$ point $(k_xd_x,k_yd_y)=(0,0)$ to obtain the following expression for the dispersion characteristics:

$$(k_y d_y)^2\left[\frac{2\frac{\delta}{\lambda_r} + \frac{\Delta\omega}{\omega_r}}{8\frac{\Delta\omega}{\omega_r}}\right] - (k_x d_x)^2\left[\frac{2\frac{\delta}{\lambda_r} - \frac{\Delta\omega}{\omega_r}}{8\frac{\Delta\omega}{\omega_r}}\right] = 1 \quad (10)$$

Equation (10) reveals the hyperbolic nature of the dispersion characteristics for the metamaterial of FIG. 3, under the geometrical arrangement described by equations (5) and (6). Equation (10) also implies that below resonance $\Delta\omega<0$, the hyperbolas intercept the $k_xd_x$ axis whereas above resonance $\Delta\omega>0$, they intercept the $k_yd_y$ axis. Additional insight into the dispersion characteristics based on equation (10) is discussed below.

Figure 4:
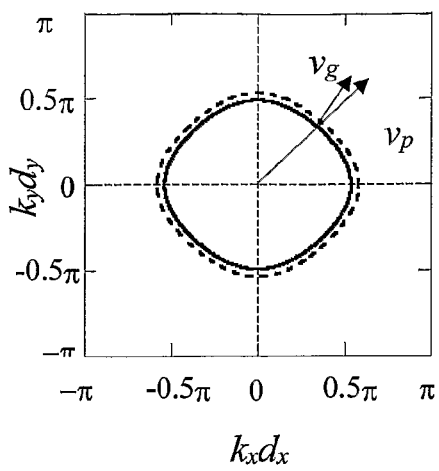
FIG. 4 illustrates a first Brillouin zone of the constant-frequency dispersion surfaces showing elliptical dispersion at an off-resonance frequency and hyperbolic dispersion about the resonant frequency, the dotted curves corresponding to dispersion at higher frequencies so that the group velocity vector is directed from the solid to the dotted curve.
Figure 4:
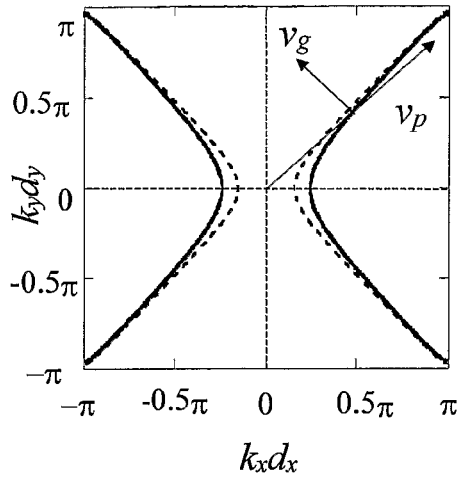
Figure 4:
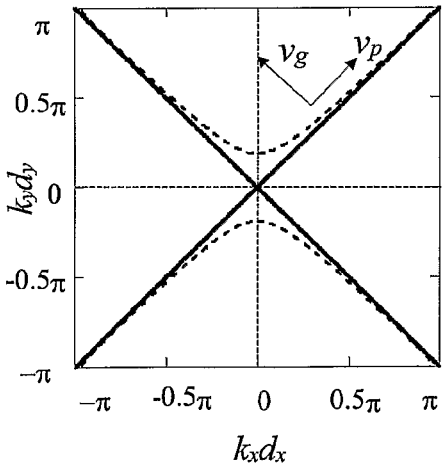
Figure 4:
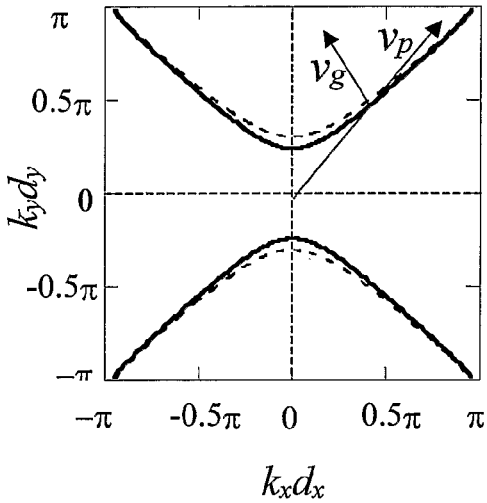

The dispersion characteristics of the metamaterial of FIG. 3 can be further understood by drawing the constant-frequency surfaces. For a representative example, assume $\beta_x=\beta_y=\beta=2\pi f/c$ and $f_r=6$ GHz. In this case, the resonance condition (1) is satisfied for intrinsic phase shifts of $\beta(f_r)dx=200°$ and $\beta(f_r)d_y=160°$. These correspond to grid periodicities $d_x=27.8$ mm and $d_y=22.2$ mm along the x- and y-axes, respectively. Assuming the grid structure of the metamaterial shown in FIG. 3 extends infinitely in all directions, the corresponding constant-frequency dispersion surfaces in the first Brillouin zone are calculated using the fall dispersion equation (4) and are shown for several different frequencies in FIG. 4. Away from resonance, i.e. at a frequency of 2 GHz, the dispersion surface is elliptical (FIG. 4*a*) with major and minor axes proportional to the axial phase shifts per unit cell in the x and y directions. Since the group velocity is the gradient of the dispersion surface, the Poynting vector is normal to the dispersion surface and points in the direction of increasing frequency.

As depicted in FIG. 4*a*, the phase and group velocities do not, in general, point in the same direction, which is typical for anisotropic media. However, the angle between the two vectors is small at these off-resonance frequencies. On the other hand, the situation is different for frequencies close to resonance where the dispersion surfaces become hyperbolic. As shown in FIG. 4*b*, the phase and group velocity vectors at 5.95 GHz are almost perpendicular to each other. If the electric field is detected along the direction of the group velocity vector $v_g$, a large number of k-vectors will have their corresponding group velocities pointing in the same direction, giving rise to strong fields or resonance cones. Exactly at the resonant frequency $f_r$=6.0 GHz, the dispersion characteristics become a set of perpendicular straight lines oriented along the diagonal directions $k_xd_x=\pm k_yd_y$ as shown in FIG. 4*c*. In this case, the group velocity becomes exactly perpendicular to the propagation vector thus implying that along the resonance cones there is no phase variation incurred (i.e. zero phase velocity). Above resonance, at 6.05 GHz, the dispersion characteristics become hyperbolic again (see FIG. 4*d*) but now the orientation of the hyperbolas is at 90 degrees with respect to those at 5.95 GHz. Another interesting feature can be revealed by noting that at resonance the dispersion lines pass through the origin. As the frequency is increased, hyperbolas are formed that depart symmetrically away from the origin along the $k_yd_y$ axis. As the frequency is reduced, the corresponding hyperbolas depart symmetrically away from the origin but along the $k_xd_x$ axis. Therefore above resonance, propagation along the y-axis corresponds to a forward wave (i.e. phase and group velocities are parallel) whereas below resonance propagation along the x-axis corresponds to a backward wave (phase and group velocities are anti-parallel). This situation is reversed if $\delta<0$. The above discussion is consistent with equation (10). The bandwidth over which the dispersion remains hyperbolic can be obtained by examining dispersion expressions (9) and (10) while insisting that the factors multiplying the $(k_xd_x)$, $(k_yd_y)$ terms remain positive:

$$|\Delta f/f_r|<4\delta/\lambda_r \tag{11}$$

To study refraction and focusing of resonance cones, consider the grid of unit cells shown in FIG. 3 connected to a transposed grid whose unit cell dimensions are given by $d'_x=d_y$ and $d'_y=d_x$, i.e. the two grids have interchanged periodicities along the x- and y-directions. Assuming the grids are large enough so that full dispersion equation (4) holds, consider an electromagnetic source placed in one of the grids, defining a source grid. The resulting ray picture is illustrated in k-space in FIG. 5*a*. Note that the constant-frequency surface of the first grid (periodicities: $d_x$, $d_y$) is a hyperbola that is symmetric about the x-axis. On the other hand, the transposed grid (periodicities: $d'_x$, $d'_y$) has its axis of symmetry along the y-axis. These observations are consistent with dispersion equation (10). Looking at FIG. 5*a*, consider a group velocity vector $v_{g1}$ that originates in the source grid and travels towards the interface. By matching the transverse $k_y$ vectors, two possible solutions $v'_{g1}$ and $v''_{g1}$ can be identified in the image grid. However, only $v'_{g1}$ represents the correct solution as it corresponds to forward energy propagation (i.e. away from the source grid). As a result, electromagnetic power bends negatively, as indicated by the direction of the group velocity $v'_{g1}$ in the image grid. The above discussion can be extended to the second group velocity vector $v_{g2}$ that propagates from the source grid to the interface.

Hence every group velocity vector originating from the source grid bends inwards in the image grid, resulting in resonance-cone focusing. The nominal propagation paths of the resonance cones, translated to the x-y space, are designated by solid lines in FIG. 5*b*. The intensity and the location of the focus depend on the frequency of operation. At the resonant frequency, the focus is formed at a point that is symmetrically located about the interface with respect to the source grid. The resonance cones in this case propagate exactly on the source grid diagonal as indicated by the dotted ray profile in FIG. 5*b*. The source and image in this case are both located at the $3^{rd}$ cell from the interface.

Negative refraction and related focusing of resonance cones in infinite periodic hyperbolic grids have been described above. Microwave simulations exhibiting negative refraction and related focusing of resonance cones in practical, truncated transmission line grids will now be described. Consider a truncated version of the grid network of FIG. 5*b*, which includes two transposed 5×2 unit cell anisotropic grids interfaced along the y-axis. The grid network is put together using ideal (lossless) transmission lines of characteristic impedance 100 Ω in a microwave simulator. The open-ended edges are terminated through 50 Ω resistors. A voltage source is placed at the upper left corner of the grid network and grid-to-ground voltages at each node are detected and plotted on surface intensity graphs in FIG. 6*a*. The resonance cone formation and its Bloch refraction are clearly observed at the resonance frequency of 6 GHz. As will be appreciated, the use of ideal (lossless) transmission lines leads to perfect transmission from the input node (0,5) to the output node (0,0).

To observe focusing, consider a larger grid network comprising two interconnected 3×10 unit cell transposed grids interfaced along the x-axis. The left grid is excited at node (0,5) which lies at the left edge of the grid, located half-way between the lower and the upper left corners of the grid network. The resulting voltage profile at the resonance frequency of 6 GHz is shown in FIG. 6*b*. The resonance cones emanate in the form of two beams that meet in the second grid after refracting negatively at the interface. As shown in FIG. 6*b*, this results in the formation of a strong focal spot at the anti-diametric node (7,5). To demonstrate the variation of the position of the focal spot with frequency as suggested by FIG. 5, FIG. 6*c*. shows the voltage distribution at the lower frequency of 5.83 GHz. As shown, the focal spot has retracted towards the interface and forms at node (5,5).

The grid network was implemented and characterized in microstrip technology allowing the frequency variation of the focal spot to be characterized in more detail. The formation of the sharp beams along with their associated angular swinging with frequency suggests a wide range of applications for the grid network, including spatial-frequency filtering and multiplexing.

Figure 5:
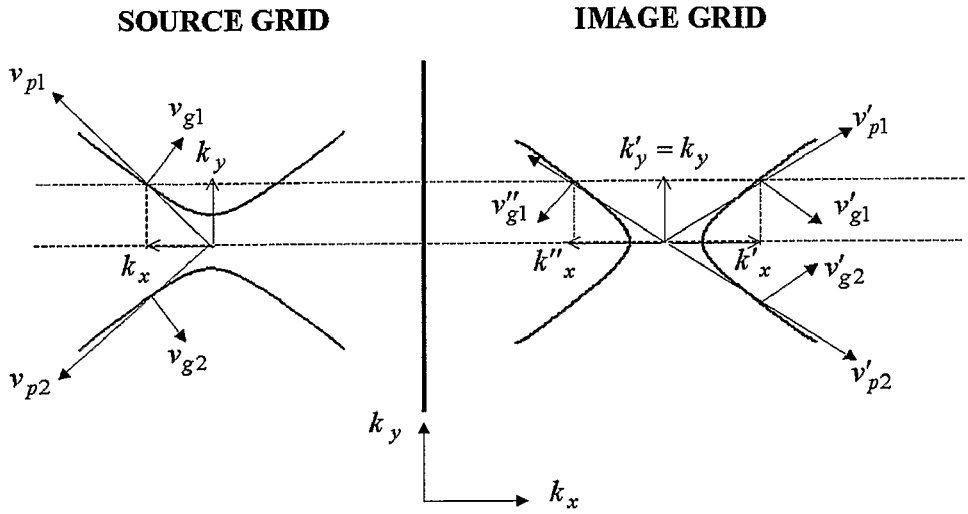
FIG. 5 shows negative refraction and focusing of resonance cones in (a) k-space and (b) real space, the dotted path corresponding to the resonance frequency $f_r$ and the solid path corresponding to a higher frequency $f>f_r$.
Figure 5:
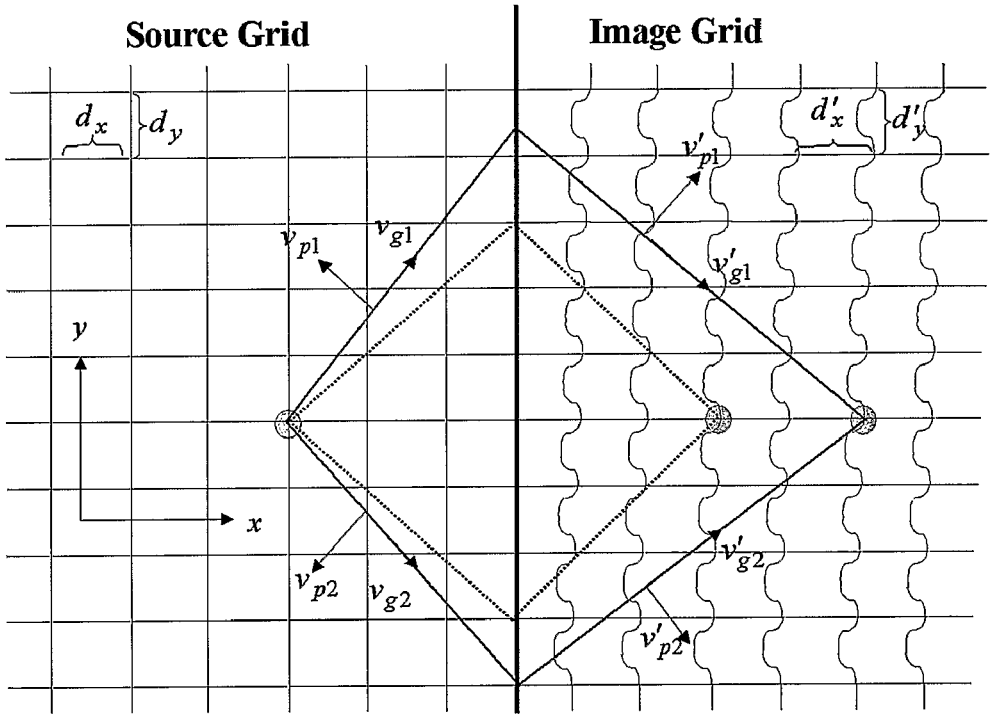
Figure 6:
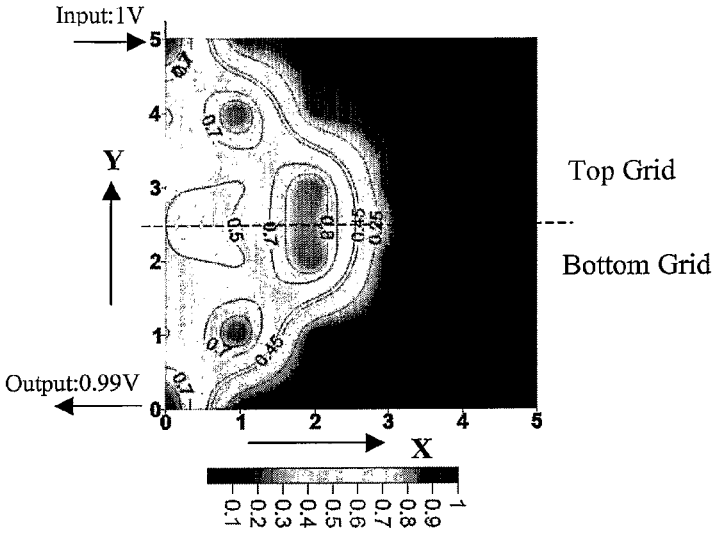
FIG. 6 illustrates microwave-circuit simulations showing grid voltages (V) to ground on two interconnected 2D ideal TL grids, having interchanged anisotropy for (a) negative-refraction at 6 GHz, (b) focusing at 6 GHz and (c) focusing at 5.83 GHz, the x-y axes designating nodal co-ordinates.
Figure 6:
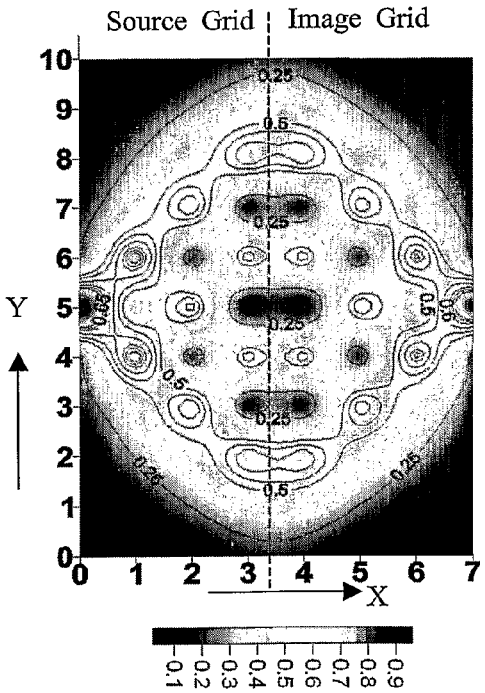
Figure 6:
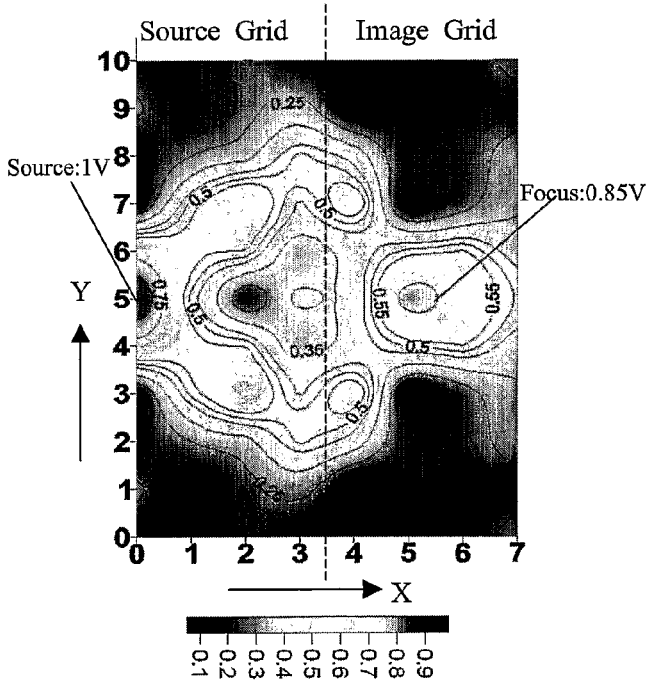

An interesting feature of the negative refraction illustrated in FIG. 6 is the apparent lack of specular reflection at resonance. This "perfect" refraction can be explained by considering the longitudinal Bloch impedances in the two transposed grids in the network. With reference to FIG. 5, in the first (left) grid, the x-directed Bloch impedance is obtained from equation (10) of A. Grbic and G. V. Eleftheriades, "Periodic analysis of a 2-D negative refractive index transmission line structure", *IEEE Transactions on Antennas and Propagation: Special Issue on Metamaterials*, $$Z_{x_Bloch} = Z_{ox}\frac{\tan\left(\frac{\beta_x d_x}{2}\right)}{\tan\left(\frac{k_x d_x}{2}\right)} = Z_{ox}\frac{\tan\left(2\pi\frac{\delta}{\lambda_r}\right)}{\tan\left(\frac{k_x d_x}{2}\right)} \quad (11)$$

vol. 51, no. 10, pp. 2604-2611, October 2003:

The second form of the Bloch impedance in equation (11) is obtained by utilizing equation (7) (at resonance $\Delta\omega=0$). In the transposed grid, a similar expression for the Bloch impedance applies but now in the numerator there is a negative sign since $\delta<0$. However, at resonance, the Bloch propagation constant in the transposed grid is equal and opposite in sign to $k_x d_x$. Therefore with $Z_{ox}=Z_{oy}$, the longitudinal Bloch impedances in the two transposed grids are matched, resulting in no specular reflection.

Figure 7:
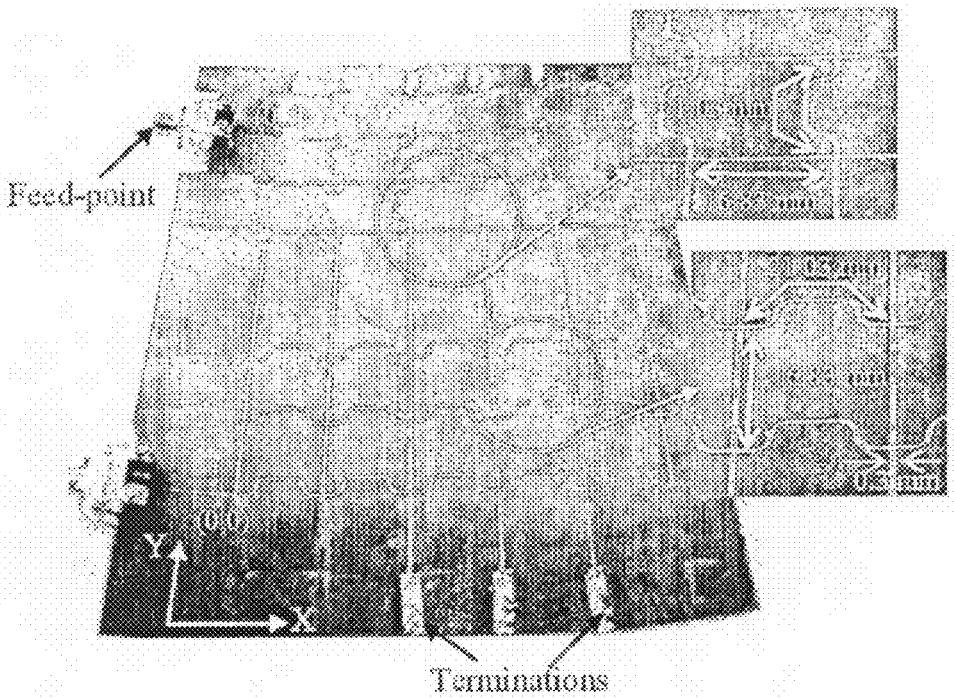
FIG. 7 is a photograph of a microstrip-based hyperbolic grid that demonstrates negative refraction of resonance-cones around 6 GHz.

To demonstrate resonance cone formation and negative refraction in a realizable anisotropic hyperbolic grid network, the structure simulated in FIG. 6*a* was fabricated using microstrip technology and tested. In this implementation, a metallic microstrip-based grid was printed on a Rogers 5880 substrate by placing two interconnected 5×2 unit cell 2D microstrip grids side-by-side with interchanged periodicities, as depicted in FIG. 7. The parameters for the substrate used are shown in Table 1.

TABLE 1

Substrate Parameters

| A. Substrate property | B. Value |
|---|---|
| Permittivity | 2.18-2.24 (10 GHz) |
| Thickness | 15 mils |
| Loss tangent | 0.0009 (10 GHz) |
| Copper Conductivity | $5.8 \times 10^7$ siemens/m |
| RMS Conductor Surface Roughness | 3 μm |

By setting the intrinsic phase shifts at $f_r$=6 GHz to be $\beta_x d_x$=200° and $\beta_y d_y$=160°, the corresponding periodicities $d_x$, and $d_y$ of the first grid are given by 21.03 mm and 16.83 mm, respectively. As shown in FIG. 7, microstrip bends are introduced in both grids to accommodate for the longer cell length in one of the two orthogonal directions and maintain geometrical symmetry. Assuming a characteristic impedance of 100 Ω, all the microstrip lines on the grids are 0.3 mm wide. Nominal 50 Ω resistors are used to terminate the grid as shown in FIG. 7. The top grid was fed at the left corner node (0,5) using an Agilent 5250 Vector Network Analyzer (VNA).

Figure 8:
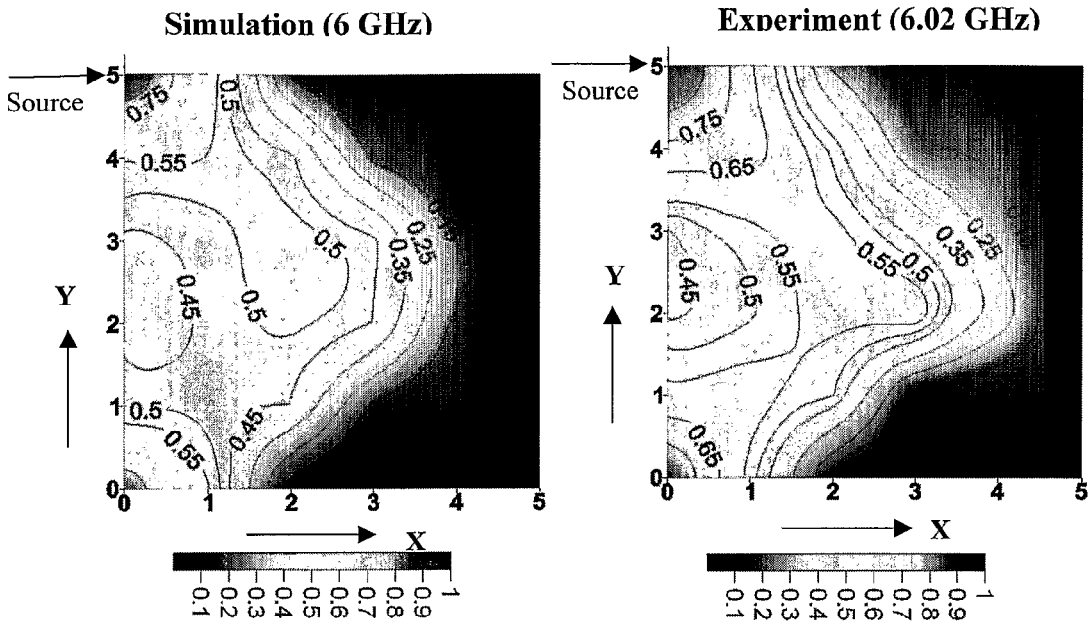
FIG. 8 shows a simulation of negative refraction of resonance cones in microstrip-based hyperbolic grids using surface intensity/contour plots that show normalized voltage (V) magnitudes to ground on grid nodes, the x-y axes designating nodal co-ordinates.

To measure the electric fields on the grid nodes, the second port of the VNA was connected to an open-ended vertical coaxial probe, which was placed on each grid node at a distance much smaller than the wavelength. The probe was attached to an X-Y scanner that sequentially scanned the grid by means of a stepper motor, and the transmission coefficient $S_{21}$ were measured at all the nodes. This procedure ensured that the magnitude of the measured $S_{21}$ was proportional to the node voltage to ground. For verification purposes, the same grid was also laid out using a microwave simulation package and the voltages to ground were detected by placing a high impedance port at each node. The normalized simulation and measured data at resonance (6 GHz in simulation and 6.02 GHz in experiment) were plotted as surface intensity plots with constant-magnitude contours as shown in FIG. 8. In both cases, the resonance cones emanating from the source propagate diagonally on the grids and intersect the x-axis again at node (0,0), after refracting negatively at the interface that is located between co-ordinates 2 and 3 on the y-axis. FIG. 7 indicates that there is good agreement between the simulated and measured voltage distributions. In simulation, substrate and conductor losses are taken into account (see Table 1). Moreover as shown in FIG. 8, the measured and simulated voltage amplitude drops from 1V at the input node (0,5) to about 0.75 V at the output node (0,0) due to losses. These losses are further examined below.

This beam-like power flow results in high forward transmission and low return loss at the resonant frequency. In order to characterize this transmission more precisely, a second connector was placed at node (0,0) and the corresponding reflection and transmission coefficients were directly measured. Ideally, without any losses, the simulated transmission coefficient was found to be $S_{21}$=0 dB at resonance (see FIG. 6*a*) whereas $S_{11}$ was found matched. However, at resonance an approximately 3.65 dB drop in $S_{21}$ was measured whereas the measured $S_{11}$ was better than −15 dB. This drop in transmission is due to conductor, dielectric and connector losses. A corresponding loss budget at resonance obtained with the aid of a microwave circuit simulator is shown in Table 2.

TABLE 2

Loss Budget of the Fabricated Structure of FIG. 7 at Resonance

| Loss type | Value |
|---|---|
| Dielectric Losses | 0.3 dB |
| Conductor Loss | 1.25 dB |
| Conductor roughness | 0.95 dB |
| Total simulation losses | 2.5 dB |
| Connector Losses | 0.65 dB |
| Fabrication imperfections | 0.5 dB |
| Total Measured Losses | 3.65 dB |

The transmission in the microstrip-based hyperbolic grid network can be improved by employing methods to decrease conductor losses, which are inherently present in microstrip lines. These conductor losses depend inversely on the substrate thickness and the line-width. However, for substrates that are too thick, the dielectric (and surface-wave) losses will increase leading to additional transmission loss. On the other hand, due to the phase sensitivity present in these grid networks, the use of transmission lines that are too wide can cause phase deviations, also resulting in increased losses. Therefore there is an optimum transmission line width for a given substrate thickness. An investigation with a microwave circuit simulator using a 31 mils substrate revealed an optimum transmission line width of 1 mm. Using such a transmission line width would then exhibit a transmission coefficient ($S_{21}$) of −1.3 dB, an improvement of about 1.2 dB when compared to the grid network of FIG. 7.

Figure 9:
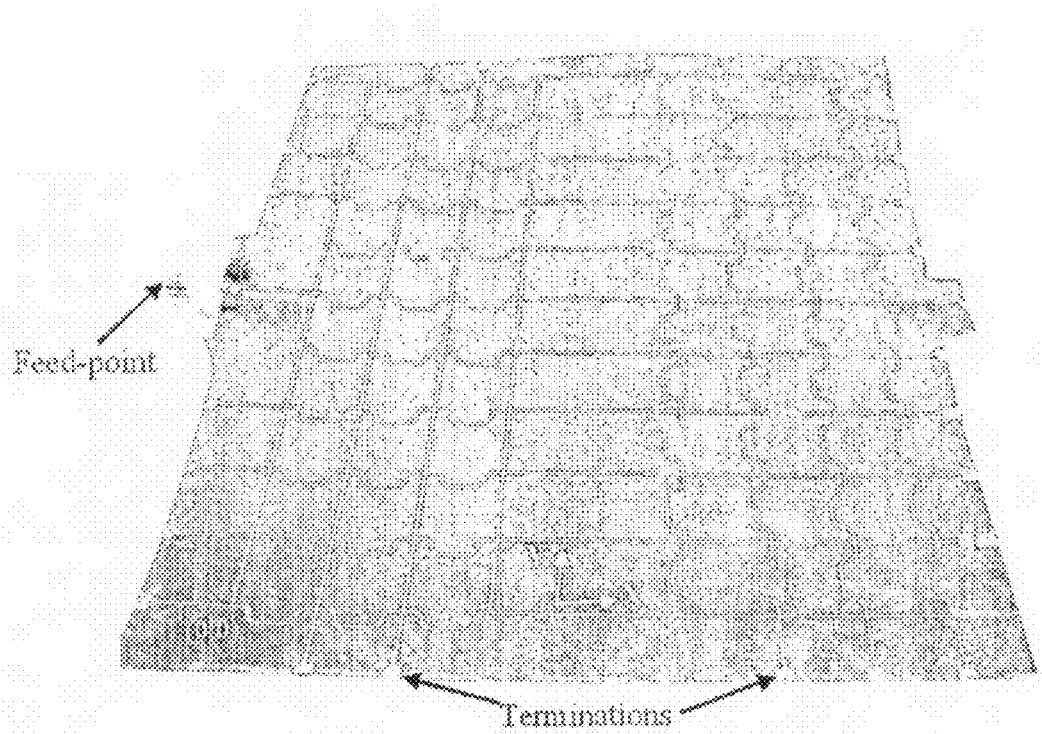
FIG. 9 is a photograph of a microstrip-based hyperbolic grid that demonstrates focusing of resonance-cones around 6 GHz, the origin, source and focus nodal co-ordinates being labelled.

To study focusing of resonance-cones in the hyperbolic grid networks, a larger grid network having the same unit cell dimensions as in FIG. 7 was fabricated as shown in FIG. 9. Each of the two grids comprises 3 unit cells along the x-axis and 10 unit cells along the y-axis. As depicted in FIG. 9, the grids are connected by one-wavelength lines and the resulting interface lies along the y-axis. The grid network was excited at node (0,5) and each grid-node was probed to determine $S_{21}$ (which is proportional to the vertical electric field or voltage to ground).

Figure 10:
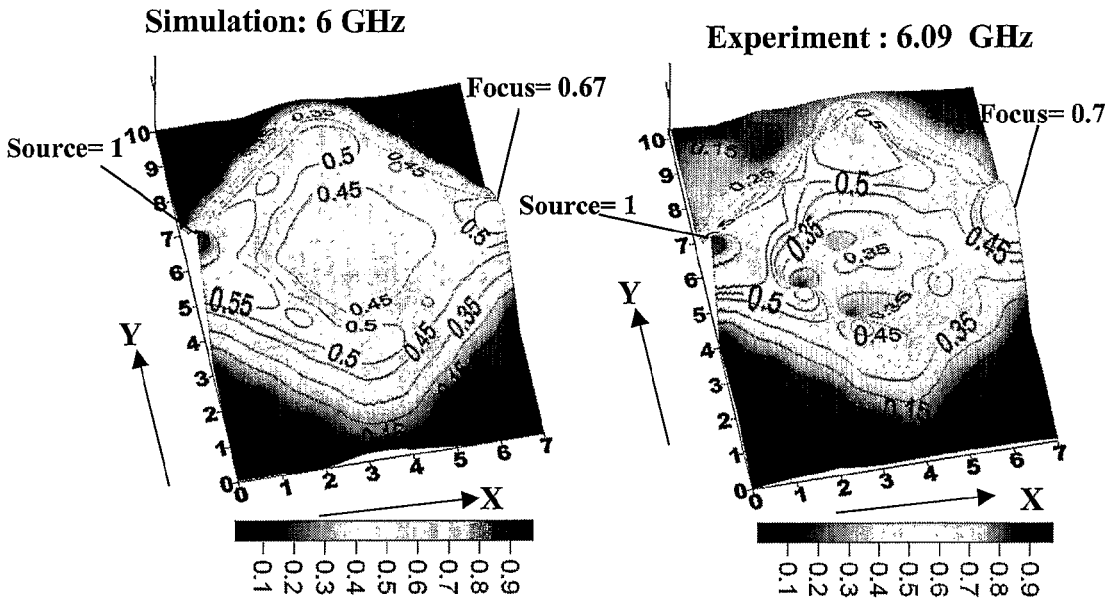
FIG. 10 shows simulation and experimental surface plots illustrating focusing of resonance-cones in hyperbolic grids at the resonant frequency wherein the scale shows normalized voltage magnitudes (V) to ground, the x-y axes designating nodal co-ordinates.

The simulation and experimental voltages/$S_{21}$ at the resonance frequency were plotted using surface intensity plots and are depicted in FIG. 10. In both experiment and simulation, resonance-cones emanating from the source, refract negatively at the interface and meet in the second grid at node (7,5) to form a focal spot, which is symmetrically located about the interface with respect to the source (also see FIGS. 5 and 5*b*). The measured relative strength of the focal spot with respect to the source was about 0.67V vs. 0.7V in simulation.

Figure 11:
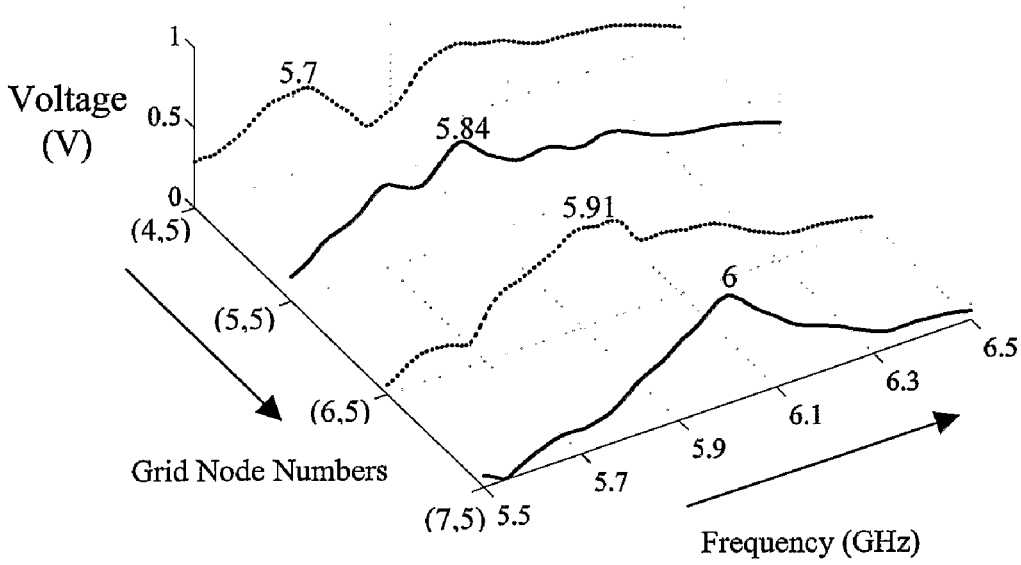
FIG. 11 illustrates three-dimensional (3D) plots showing the voltage-frequency relationship, normalized to the maximum source voltage, observed on grid nodes along row 5 in a second hyperbolic grid, the labels on the peaks designating the corresponding operating frequencies.
Figure 11:
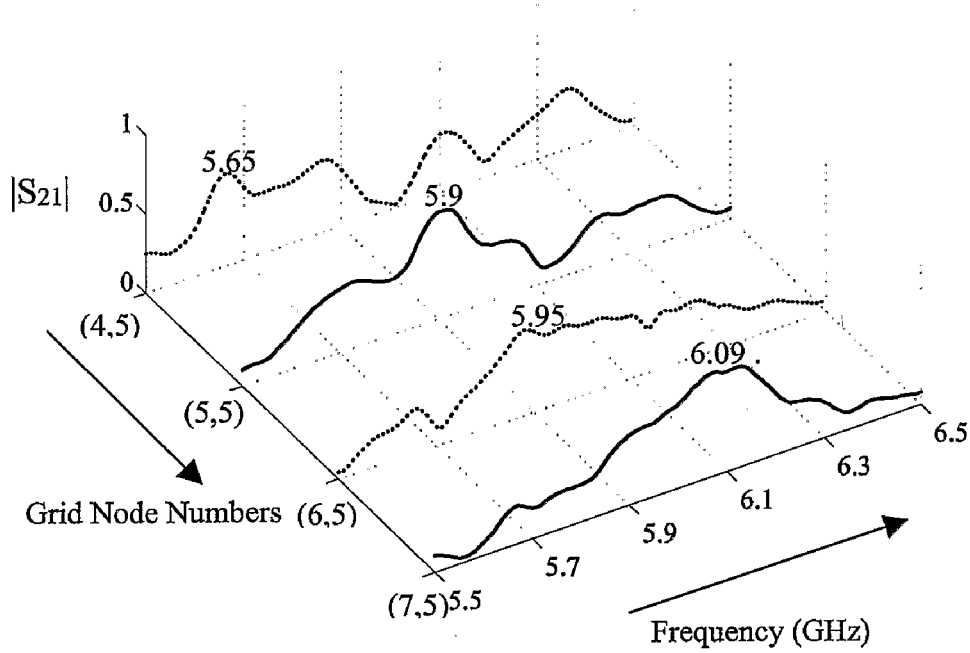

In order to characterize the frequency variation of the focal spot, the simulated and measured voltage as a function of the frequency along the central unit cell row of the second grid is shown in FIG. 11. As can be seen, the focal spot retracts towards the interface as frequency decreases in accordance with FIGS. 5 and 6*c*. For example, in the experiment, the 5.6 GHz and 5.93 GHz resonances (simulation: 5.5 GHz and 5.83 GHz) are observed at nodes (4,5) and (5,5) respectively.

Simple 2D planar anisotropic periodic grids have been presented, demonstrating the formation of sharp beams (resonance cones) as well as their negative refraction and focusing at an interface. The grid networks are constructed by arranging printed transmission lines in 2D anisotropic grids thus leading to ease of fabrication, scalability with frequency and low cost. The formation of the resonance cones and their unique and useful properties arise due to the hyperbolic spatial dispersion characteristics of the grids. Specifically, the resonance cones are shown to refract negatively and focus when two grids with transposed anisotropic axes are interfaced together. The hyperbolic dispersion characteristics of the proposed grids was proven and analyzed using rigorous 2D periodic transmission line theory.

A combination of two transposed 5×2 unit cell anisotropic grids was designed and fabricated in microstrip technology. Based on this structure, microwave measurements verified the formation of resonance cones and their negative refraction at 6 GHz. Moreover, focusing of resonance cones was demonstrated experimentally using two interconnected 3×10 cell transposed grids, also around 6 GHz. Furthermore, the complete frequency variation of the corresponding focal spot was measured and characterized.

Since the proposed periodic grid networks do not use passive loading elements or vias, their implementation can be scaled from microwave to millimetre-wave frequencies. Furthermore, a wide range of applications can be identified such as multiplexers, de-multiplexers and spatial filters. For completeness it should be pointed out that the same wire-grid over ground approach can be utilized for implementing isotropic grids and observe negative refraction and focusing of cylindrical waves (instead of resonance cones).

Figure 12:
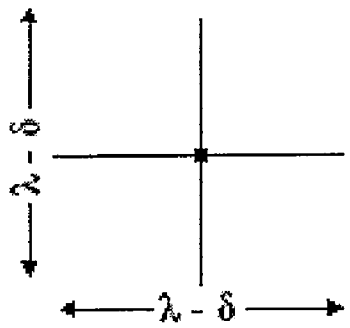
FIG. 12 shows an isotropic negative-refraction medium including a continuous 2D grid of transmission lines without any embedded elements (chip or printed) or vias in which (a) shows backwards and (b) shows complementary forward transmission-line grids.
Figure 12:
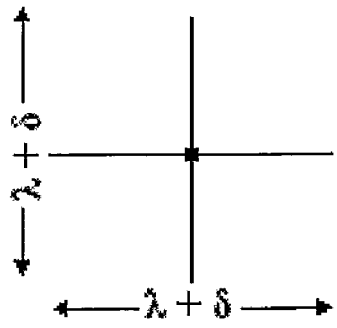
Figure 13:
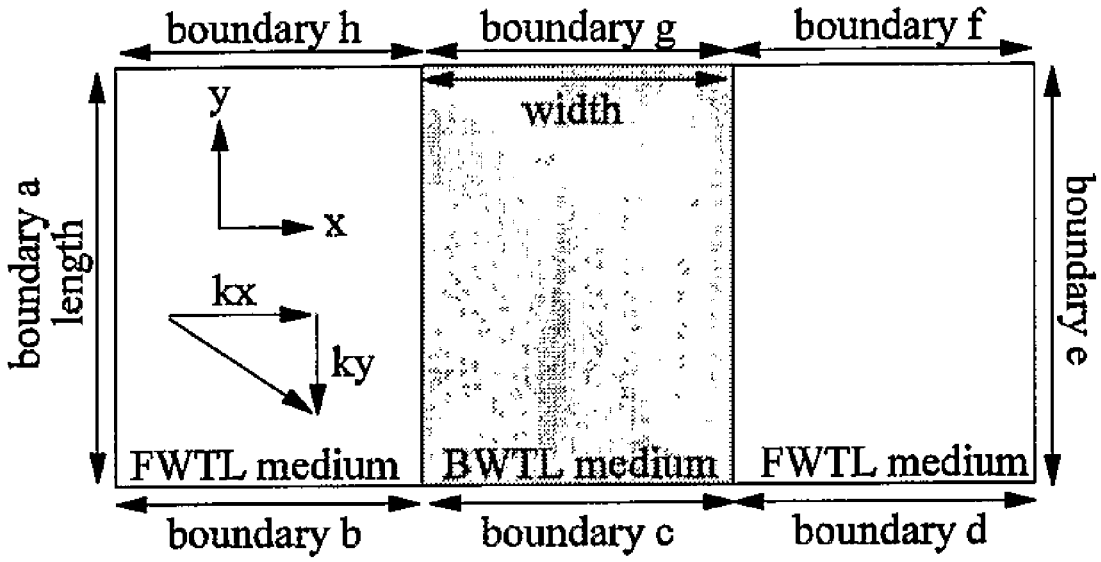
FIG. 13 shows a backward transmission line grid sandwiched between two forward transmission line grids in a planar focusing setup.

An isotropic negative-refraction medium consisting of a continuous 2D grid of transmission-lines without any embedded elements (chip or printed) or vias is depicted in FIG. 12. The dimensions of each unit cell are on the order of a wavelength, thus it cannot be considered a homogeneous medium. Hence it is not possible to define an effective permeability and permittivity. However, this structure can support backward waves and is capable of sustaining growing evanescent waves. This grid may take the form of a backward-wave transmission-line (BWTL) grid or a forward-wave transmission-line (FWTL) grid. The unit cell of the FWTL grid is depicted in FIG. 12(*a*) and is in the form of a square cross of connected transmission-lines with a node spacing of $\lambda-\delta$ where $\delta$ is a small differential length. The BWTL grid is the same except its unit cells have a dimension of $\lambda+\delta$ square (see FIG. 12*b*). In this context we will only consider complementary BWTL and FWTL grids that have the pair of dimensions stated above. When a BWTL grid is sandwiched between two continuous FWTL grids as shown on FIG. 13, the resulting three-region arrangement can be used for point-to-point focusing and for growing evanescent waves in analogy with the left-handed lumped-element-loaded metamaterial lenses described in Grbic and G. V. Eleftheriades, "Overcoming the diffraction limit with a planar left-handed transmission-line lens," *Physical Review Letters*, vol. 92, no. 11, pp. 117403, Mar. 19, 2004.

Figure 14:
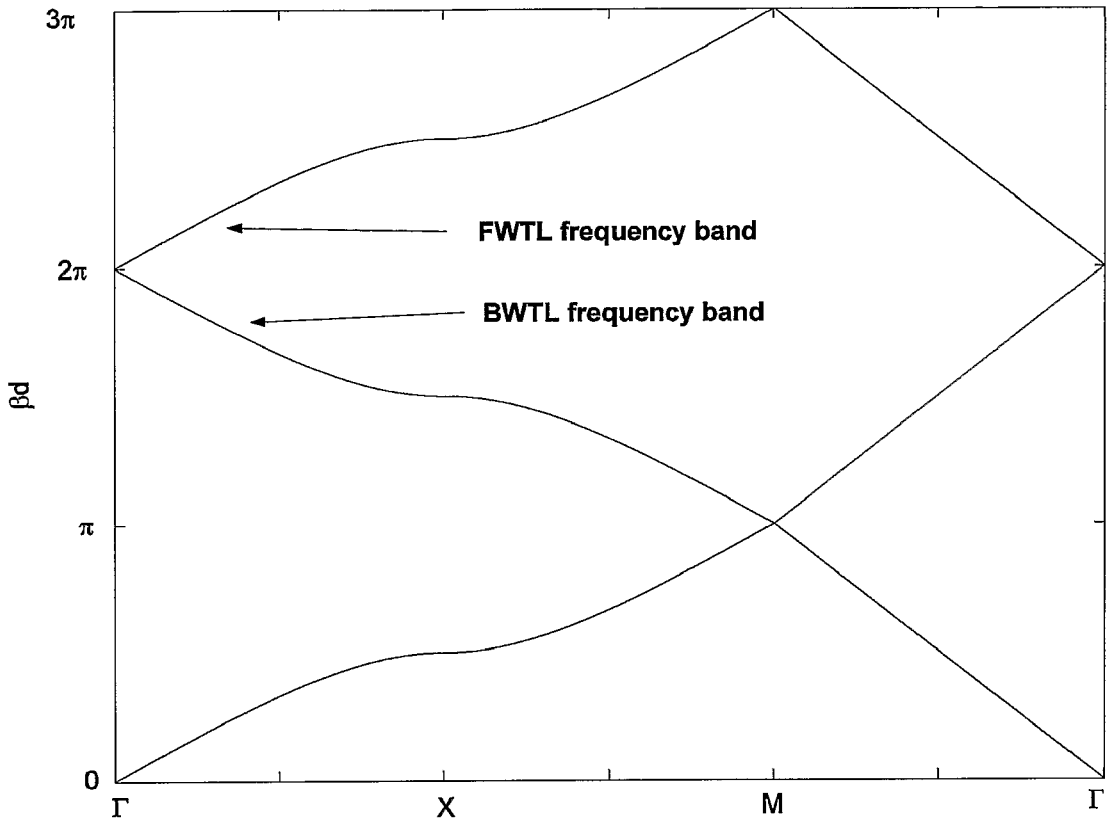
FIG. 14 shows the dispersion diagram for the grids of FIG. 12.

One way to show that the BWTL grid is indeed a backward-wave (left-handed) medium is to examine FIG. 14 which plots the dispersion diagram of the grids of FIG. 12. From FIG. 14 it can be seen that when the transmission-line propagation constant $\beta$ lies between $\pi$ and $2\pi$ the gradient of the dispersion curve, which indicates the direction of power flow, points along the opposite direction of the effective k vector. Thus when the period is $\lambda-\delta$, the longitudinal component of the effective k vector k_x must be negative in the BWTL medium whenever $\delta$ is less than $\lambda/2$.

A metallic grid, exemplified by FIGS. 2(*b*) and 3, may also support rectangular dispersion surfaces in some frequency bands, in addition to the hyperbolic dispersion. The differences between rectangular and hyperbolic resonant modes, for example, positive and negative, respectively, indices of refraction, may be exploited in the construction of various useful devices. A discussion of the relationship of these two resonant modes is a necessary precursor to evaluation of potential devices.

As discussed above, transmission-line (TL) theory in combination with the theory of infinite periodic structures (Bloch theorem) can be applied to derive the dispersion relation for metallic grids with rectangular cells. For an infinitely extended grid (extended version of FIG. 1 grid), the 2D dispersion equation assuming ideal TLs is given by equation 4 above.

Equation 4 can be used to determine eigenfrequencies corresponding to any direction of propagation given by the k-vector (kx, ky). The eigenfrequencies and the k-vector ($\omega$, $k_x$, $k_y$) can be plotted in various ways to understand the periodic behaviour of the periodic structure. If $\omega$ is plotted against phase shifts along one of the principal axes of the periodic structure ($\Gamma X$, $\Gamma Y$, or $\Gamma M$), the resulting plot is called the Brillouin diagram. The slope of the Brillouin diagram is a measure of the group velocity. At a given frequency, the plot of all possible solutions of k-vectors is called an equi-frequency surface (EFS). The group velocity is then the gradient of the EFS.

Figure 15:
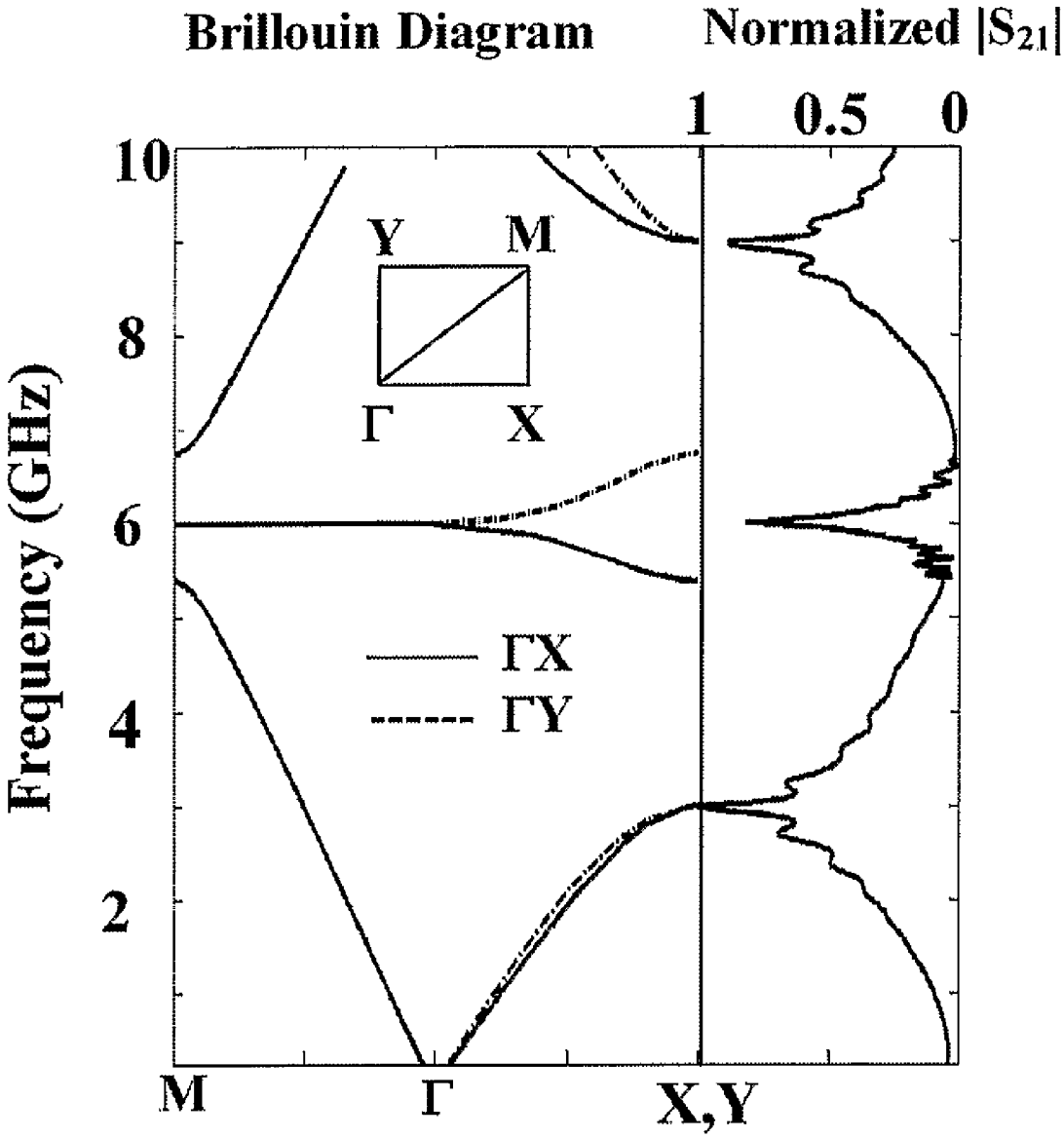
FIG. 15 shows both (Left-hand graph) the Brillouin diagram of an infinitely extended metallic grid over ground, and (Right-hand plot) the normalized transmission coefficient |S21| of the truncated grid shown in FIG. 1 with dx=0.028 m and dy=0.022 m, simulated at the corner termination that is diagonally opposite to the corner feed.

To study the dispersion characteristics, the Brillouin diagram of the grid shown in FIG. 3 with dx=28 mm and dy=22 mm is plotted in FIG. 15. Adjacent to the Brillouin diagram, a plot of the simulated transmission coefficient (S21) of the structure is also given. The S21 simulation is performed on the termination that is located diagonally opposite to the corner feed, by populating ideal TLs in Agilent's ADS microwave circuit simulator. The S21 plot of FIG. 15 shows that at frequencies 3, 6, and 9 GHz, the metallic grid resonates and the dominant energy propagates diagonally outward from the source. A comparison between the Brillouin diagram and the S21 plot reveals interesting dispersion features. Two types of modes can be identified when the metallic grid is at resonance. The 3 and 9 GHz resonances are wideband modes and coincide with the axial band edges when the group velocity is zero along both the $\Gamma X$ and $\Gamma Y$ axes. The 6 GHz resonant mode is, on the other hand, narrowband and is centered on the band edges formed by the $\Gamma Y$ forward wave and the $\Gamma X$ backward wave. The two modes are further discussed in the next sub-sections. Mathematically, the resonant modes are eigenfrequency solutions of the dispersion relation (Eq. 4)

when the right-hand side becomes zero. Two possible solutions corresponding to two resonant modes are given below:

$$\beta d_x+\beta d_y=(2n-1)\pi n=1, 2, 3 \quad (12)$$

$$\beta d_x+\beta d_y=2n\pi n=1, 2, 3 \quad (13)$$

For the resonant modes shown in the Brillouin diagram, the sum $\beta d_x+\beta d_y$ is equal to $\pi$, $2\pi$, and $3\pi$ for the 3, 6 and 9 GHz resonances respectively.

For a rectangular resonant mode, consider the first passband EFSs that are drawn in the First Brillouin Zone (FBZ) in FIGS. 3*a* and 3*b*. For lower frequencies, the EFSs are elliptical indicating the inherent anisotropy of the structure. In this region, the structure acts as an effective anisotropic medium since the wavelength is much longer compared to the unit cell dimensions. As the frequency approaches the first ΓX or ΓY stopbands, the energy propagation no longer takes place along the two axes and the EFSs become almost flat with rectangular shapes. Note that the Brillouin diagram (FIG. 2) also becomes flat at the axial band edges indicating zero group velocity along the ΓX and ΓY axes. Exactly at the first resonance of 3 GHz, the dispersion equation can be obtained by substituting the first resonant condition given by Eq. 12 in Eq. 4, yielding:

$$k_y d_y=\mp k_x d_x \pm \pi \quad (14)$$

Equation 14 indicates that under lossless conditions, the EFS at resonance is a perfect rectangle with sides equal to $\pi$/dx and $\pi$/dy. As shown in FIG. 3*b*, the majority of the k-vectors that intersect the flat EFS have their respective $v_g$ vectors pointing in the ΓM direction. This gives rise to the self-collimation of the $v_g$ vectors that produces a highly directive beam along the grid's diagonal. To observe the beam propagation in the actual structure at resonance, the electric field intensity is determined on the nodes of the 5×5 cell corner-excited truncated grid (of FIG. 1), by using a fall-wave thin-wire moment-method program. The normalized nodal field intensities are then plotted on a two dimensional surface plot, which is depicted in FIG. 16*c*. High electric fields are observed on the diagonal nodes, showing the resonant mode propagation. Note that FIG. 16*c* may not represent accurate inter-nodal electric fields as the plotting software interpolates the field points that lie between two nodes. Nevertheless, the plot does provide a correct representation of the nodal fields and therefore, it is useful in determining the beam direction and intensity. Also note that the resonance frequency predicted by dispersion relation (Eq. 4) is slightly different from the full-wave simulation results. This is partly due to the fact that the moment-method takes into account parameters such as the finite conductivity of the TLs that are not considered in deriving the dispersion relation.

As shown in FIG. 16*b*, the EFSs remain almost flat and perpendicular to the ΓM axis, in the vicinity of the 3 GHz resonance. Consequently, the resonance beam does not change direction though the intensity weakens and the beam widens as less vg vectors are then collimated. This is indicated by the 3.2 GHz electric field plot. The isotropic periodic structures such as the planar NRI metamaterials also exhibit flat EFSs resonant modes with square shapes.

Figure 17:
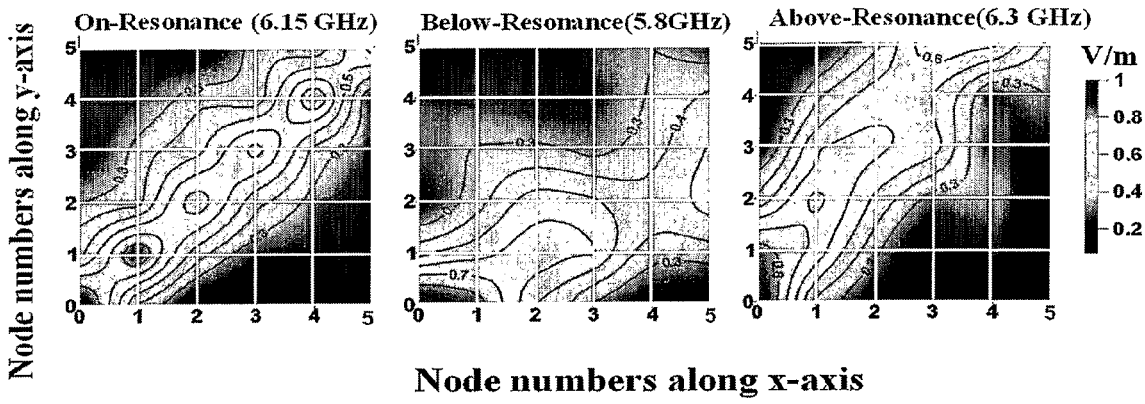
FIG. 17 shows: (a) EFSs in the second band of propagation drawn in the first Brillouin zone showing hyperbolic modes in the metallic grids; The EFSs are drawn 0.5 GHz apart and the central crossed-lines EFS is at 6 GHz; The numbers indicate frequency in GHz; and (b) A zoom-in on the first quadrant of the EFS showing the self-collimation and the frequency-dependence of the vg vectors; The dotted arrows show the k-vectors and the small solid arrows indicate the direction of the group velocity; and (c) Simulated normalized electric field intensity plots superimposed on the schematic diagram of the 5×5 cell grid, fed at node (0,0), for three different frequencies showing spatial filtering.

Hyperbolic resonant modes were discussed above. Further, and in the same context established for the discussion of the rectangular modes, consider FIG. 17. FIG. 17*a* depicts the First Brillouin zone hyperbolic EFSs that correspond to the second pass-band of the metallic grid. The mechanism of the vg self-collimation is explained in FIG. 17*b*. As the direction of $v_g$ vectors is perpendicular to the hyperbolic asymptotes, the majority of the group-velocity vectors $v_g$ align in one direction producing the resonance effect. The phenomenon is more pronounced close to resonance as more $v_g$ vectors are self-collimated due to the longer asymptotes. While a detailed discussion of the hyperbolic modes is given in above, a few important points are in order. Exactly at resonance, the EFS is a pair of intersecting lines, as obtained mathematically by substituting the resonance condition of Eq. 13 in the dispersion relation Eq. 4 (see also para. 27):

$$k_y d_y=\pm k_x d_x \quad (15)$$

The hyperbolic modes in the immediate vicinity of the resonance are directed almost perpendicular to the γM direction and do not propagate along any of the structure's main axes. In fact, the group velocity at resonance is zero along all the principal axes, as shown in the Brillouin diagram (FIG. 15). The on-resonance propagation, shown in the electric field plot in FIG. 17*c*, therefore, takes place in the third quadrant ($k_x<0, k_y>0$) of the EFS plot and not in the first quadrant. With the change in frequency, the asymptotic slope changes leading to collimated $v_g$ vectors that point in a different direction from the main resonance direction (i.e. along the grid diagonal). This frequency-dependent beam scanning of off-resonance hyperbolic modes is also illustrated in the electric field plots in FIG. 17*c*. Looking at the Brillouin diagram (FIG. 15) and the EFS plot (FIG. 17*a*), it can be observed that for the above resonance frequencies, there is no propagation along the ΓX-axis and the phase change along the ΓY-axis is positive with respect to frequency, indicating forward wave propagation. For the below resonance frequencies, the cut-off is along the FY axis and the phase change with respect to frequency is negative in the ΓX direction, leading to backward-wave propagation. For a metallic grid with transposed periodicities, the phase properties exactly get reversed so that around the resonance a forward wave propagates along the ΓX axis and a backward wave propagates along the ΓY axis. Because of these mutually compensating properties, when two such grids are connected together, negative refraction and focusing of the hyperbolic modes can be achieved.

The dispersion properties of the rectangular and hyperbolic modes can be exploited to design a frequency splitting device which guides a signal and its second harmonic to two different ports. An implementation of this concept is depicted in FIG. 18*a*, which shows two 3×6 cell metallic grids with mutually transposed periodicities connected to form a common interface. Using Eq. 4 and 12, the left grid dimensions are calculated such that the metallic grid supports rectangular and hyperbolic modes at 3 and 6 GHz respectively. Assuming $\beta d_x=100°$ and $\beta d_y=80°$ at 3 GHz, the unit cell dimensions for the left grid are given by $d_x=22.8$ mm and $d_y=22.2$ mm.

The k-space diagram, depicted in FIG. 18*b*, illustrates the propagation mechanism if a signal containing 3 and 6 GHz frequencies is fed at the input port 1, located in the left grid. By matching the y-directed vectors on both sides of the interface, the direction of group velocity vectors for both modes is obtained. It can be seen that the two modes propagate differently across the interface. The rectangular mode, centered at the Γ point on both sides of the interface passes without negative refraction. The hyperbolic mode, on the other hand, suffers negative refraction by virtue of its phase compensation property. The corresponding beam paths, depicted in FIG. 18*a*, show that the signal fed at the input port 1, splits at the interface in such a way that the two frequencies arrive at the right-hand grid ports 2 and 3 respectively. The beam propagation is also illustrated by full-wave electromagnetic field simulations shown in FIG. 19 for the two modes. Due to the impedance mismatch across the interface, some power contained in the rectangular mode reflects back into the left grid. However, no reflections are seen at the two grid interface for the hyperbolic mode propagation because of the perfect matching conditions at 6 GHz.

Figure 20:
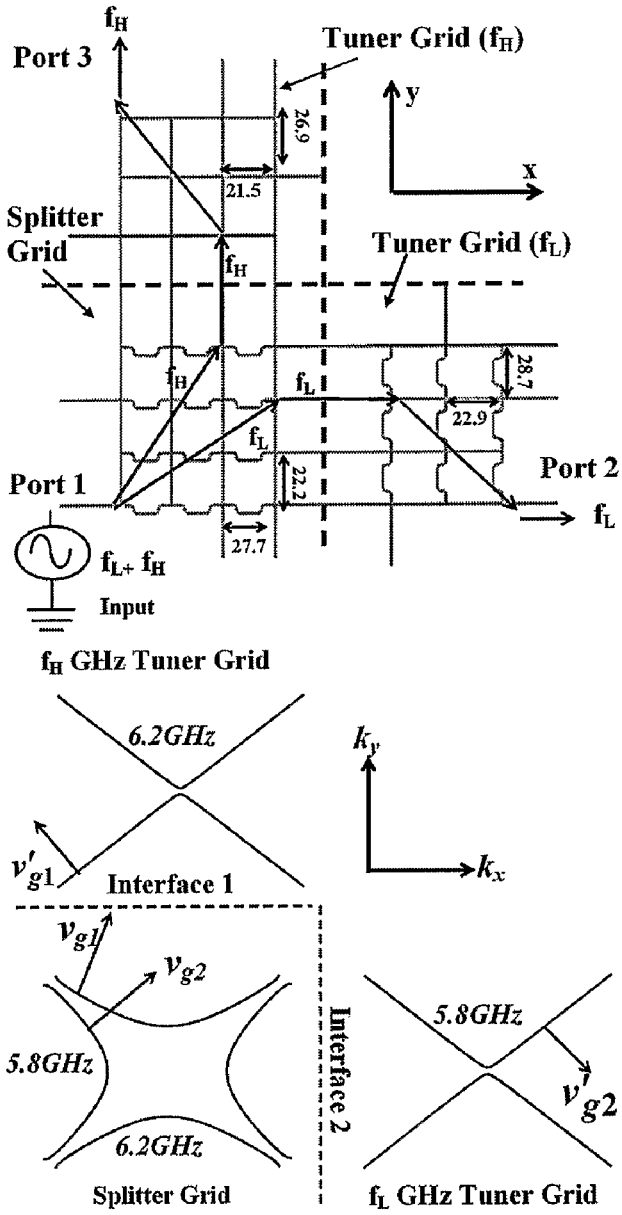
FIG. 20 shows: (a) Top view of the layout of a 3 grid diplexer. The line dimensions (in mm) correspond to a diplexer that is centered at 6 GHz with the split frequencies of fL=5.8 GHz and fH=6.2 GHz. The open ends are terminated in 50 ohm loads. The splitter grid splits the input signal fL+fH while the tuner grids guide the lower frequency fL to port 2 and the higher frequency fH to port 3; (b) The diplexer mechanism explained in k-space. At the two interfaces, phase matching is applied. For simplicity k-vectors are not shown whereas $v'_{g1}$ and $v'_{g2}$ identify the group velocity vectors that correspond to the forward energy propagation.

A diplexer is a device that splits two rather closely spaced frequencies arriving at its input port to two separate output ports while providing good isolation between them. Conventionally, it is made out of parallel filter banks connected to the source allowing one band to pass and the other to stop. Here we present a method of synthesizing a diplexer using metallic grids by manipulating the hyperbolic dispersion characteristics of the considered metallic continuous grids. A practical layout of such a device is shown in FIG. 20*a*. The diplexer consists of three grids: a splitter grid and two tuner grids. The line dimensions are calculated such that the splitter grid resonates at the center frequency of the diplexer which is assumed to be 6 GHz. The two tuner grids are designed in such a way that they resonate on the two diplexer channels i.e. 5.8 GHz and 6.2 GHz. Table 3 outlines the resonant frequencies ($f_O$) of the splitter and the tuner grids, the related phase angles at resonance, and the unit cell dimensions assuming ideal transmission lines. Note that the splitter and tuner grids have transposed phase angles to facilitate the negative refraction at the interface.

TABLE 3

Phase angles at grids' resonances and ideal TL dimensions

| Parameter | Splitter | Tuner (fL) | Tuner (fH) |
|---|---|---|---|
| $f_o$ | 6 GHz | 5.8 GHz | 6.2 GHz |
| $\beta d_x$ | 192° | 168° | 168° |
| $\beta d_y$ | 168° | 192° | 192° |
| $d_x$ (mm) | 27.7 | 28.7 | 21.5 |
| $d_y$ (mm) | 22.2 | 22.9 | 26.9 |

Figure 21:
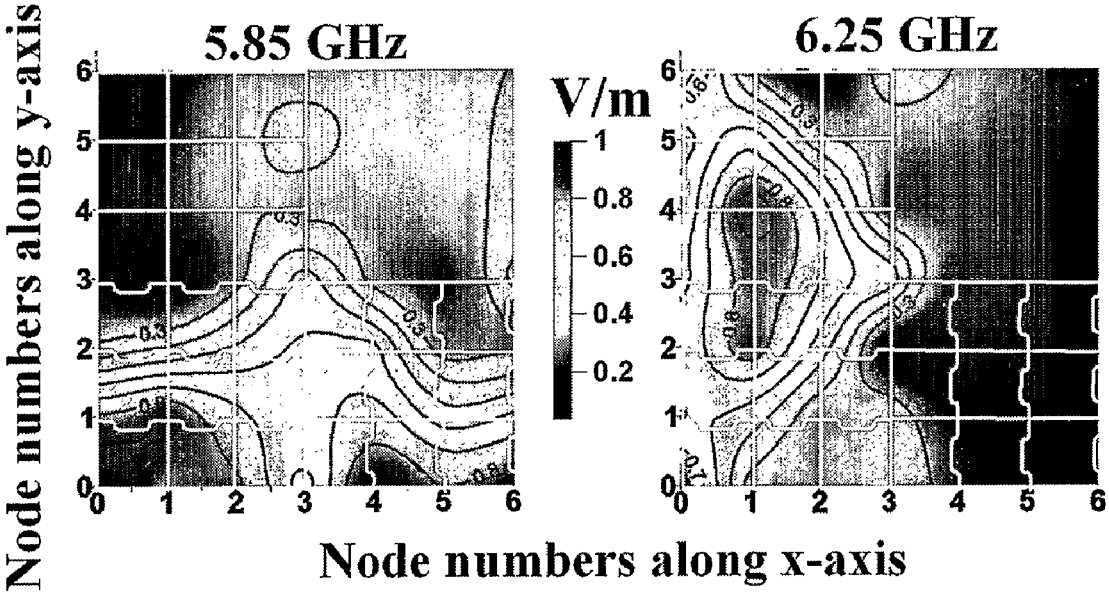
FIG. 21 shows: Simulated electric field intensity plots superimposed on the diplexer's schematic showing 5.85 GHz and 6.2 GHz beam propagation; The signal is fed at node (0,0) and the 5.85 GHz and 6.2 GHz output channels appear at nodes (6,0) and (0,6) respectively.

Consider the diplexer mechanism explained in FIG. 20*b* with the aid of a k-space dispersion diagram. Because of the difference in the asymptotic slope of the 5.8 GHz and 6 GHz hyperbolae, the two beams split within the splitter grid and reach at two different interfaces. By virtue of the negative refraction that occurs at the splitter-tuner interface, the two 5.8 GHz and 6.2 GHz signals are guided to two ports which are located orthogonally to each other. The propagation paths of the two channels are highlighted in FIG. 20*a* and are also illustrated in the electric field plot of FIG. 8. The 5.8 GHz and 6.2 GHz signals are shown to take separate paths inside the splitter grid and arrive at their respective ports after suffering negative refraction at two different interfaces. This type of a configuration has two advantages over the single-grid spatial filter of FIG. 17. First, in the tuner grids the self-collimation effect is enhanced as almost all the vg vectors point in one direction which increases the power transferred to the output port. Consequently, as depicted in FIG. 21, the resonant beams are sharper and more directed as compared to the grid of FIG. 17. Second, the two frequency output ports are located in two different grids that are orthogonal to each other, thereby increasing the isolation between the two frequencies.

Figure 18:
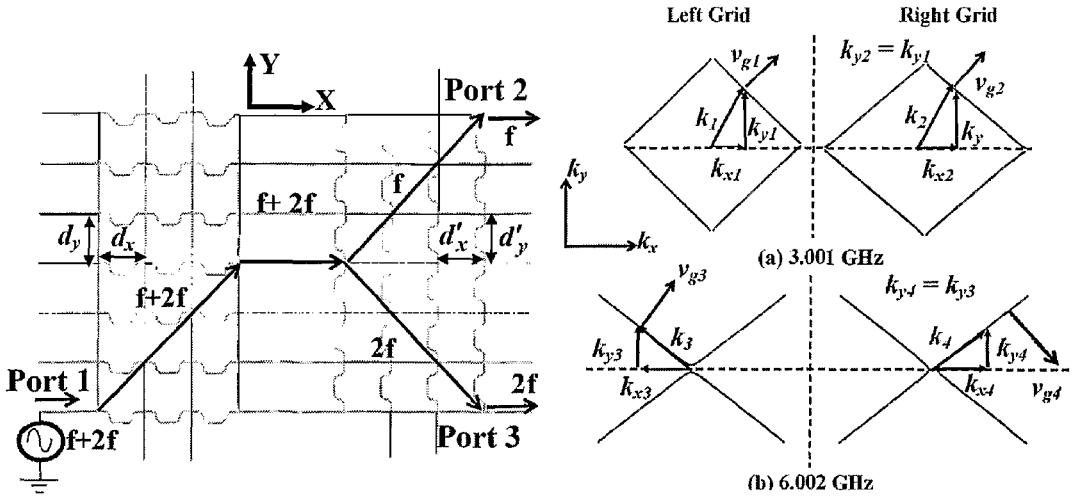
FIG. 18 shows: (a) Schematic diagram for a harmonic splitter formed by two metallic grids with transposed periodicities. (dx'=dy, and dy'=dx). The beam paths for the signal (f) and its harmonic (2f) are also shown. Bends are introduced to accommodate for longer lines within a square cell. All open ends are terminated to 50 Ohm loads; (b) K-space refraction mechanism of the splitter. Invoking phase matching at the interface (ky2=ky1, ky4=ky3), vg vectors of the rectangular mode (3 GHz) undergo positive refraction and the vg vectors for 6 GHz hyperbolic mode refract negatively.
Figure 19:
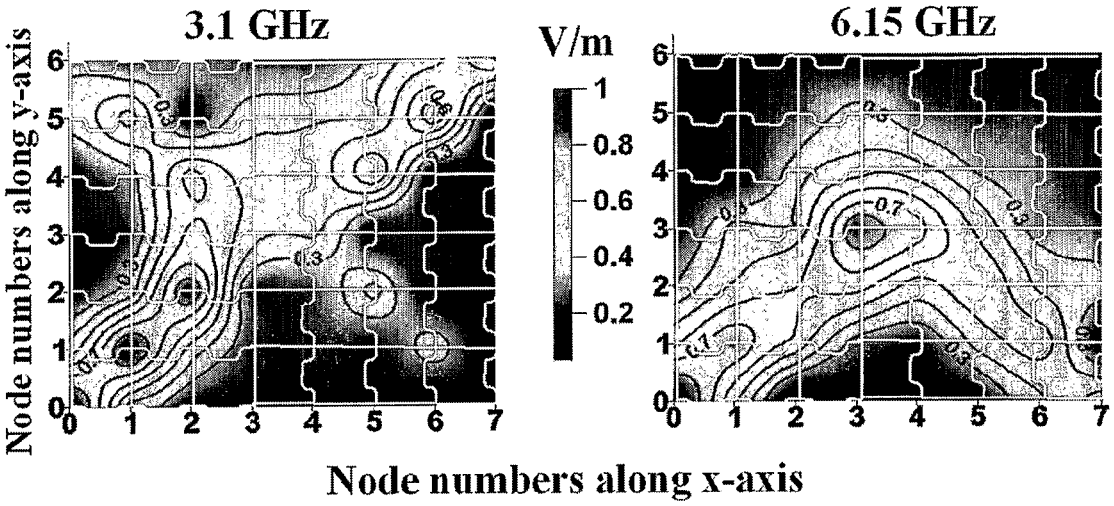
FIG. 19 shows: Simulated normalized electric field distribution plots superimposed on the splitter's schematic showing the separation of two modes at the central interface; The signal is fed at node (0,0) and the 3.1 GHz and 6.15 GHz output channels appear at nodes (7,6) and (7,0) respectively.
Figure 22:
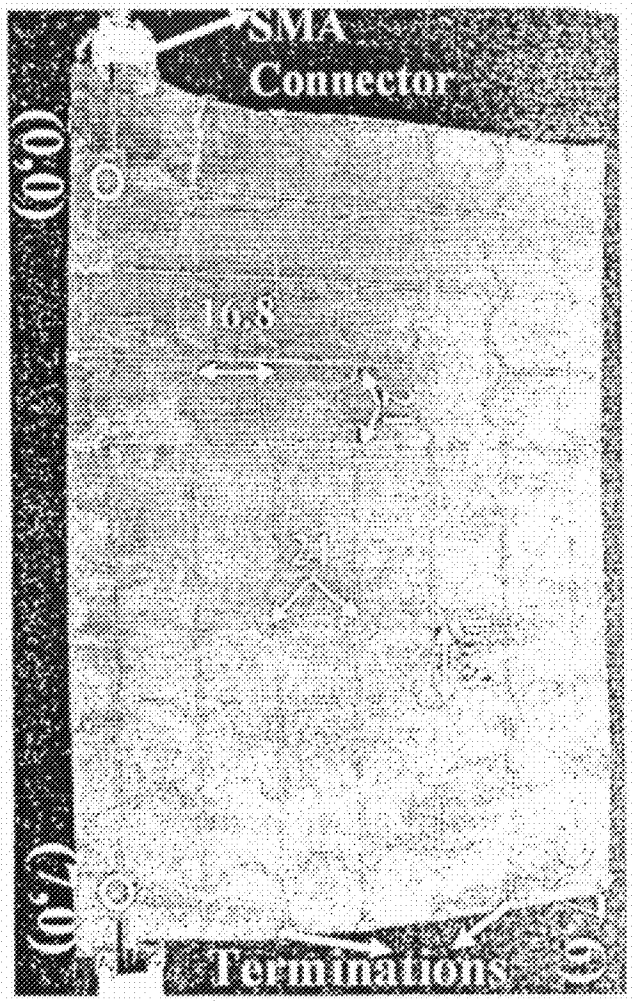
FIG. 22: The photograph of the harmonic splitter fabricated using microstrip transmission lines. The input node (0,0) and output nodes (7,0), and (7,6) are marked by circles and the unit cell lengths are shown in millimetres. All terminations are 50 Ohms.

The harmonic splitter of FIG. 18 is implemented using microstrip technology on a RT/Duroid® 5880 substrate with relative permittivity 2.2 and thickness 0.508 mm. The microstrip lines are designed for a 100 Ohm characteristic impedance, which corresponds to a line width of 0.3 mm. The corresponding line lengths in mm are marked in the photograph of the fabricated structure displayed in FIG. 22. The z-directed relative electric fields on the nodes of the splitter are measured by probing all the nodes with a probe connected to the VNA and vertically held over a node by a computerized XY scanner. The measured transmission coefficient S21 is thus proportional to the z-directed fields and therefore, can be compared to the simulation results given in FIG. 19

Figure 23:
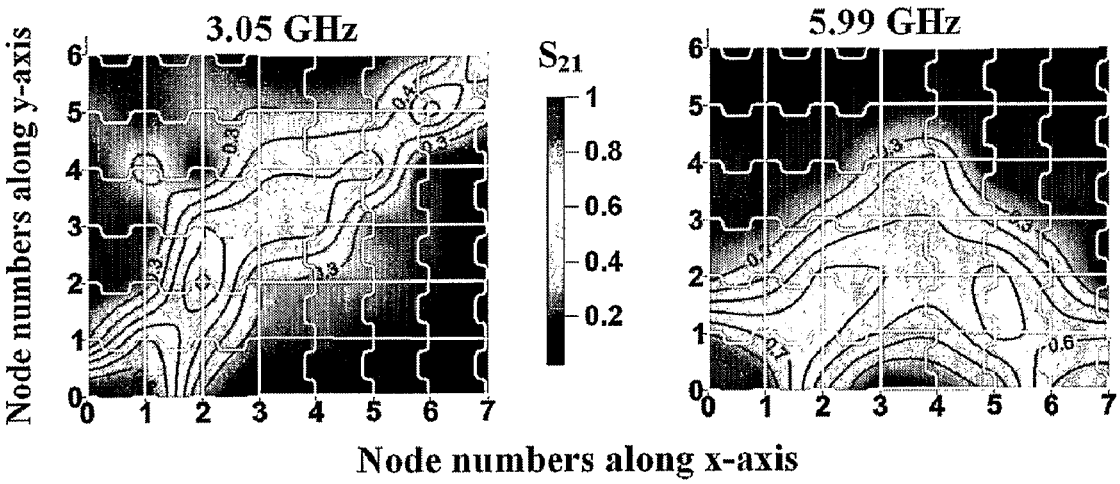
FIG. 23 shows: Surface plots of the experimentally obtained normalized vertical electric fields on the nodes of the harmonic splitter and shown for two harmonic frequencies; The surface plots show the splitting of the two harmonics at the central interface of the splitter.
Figure 24:
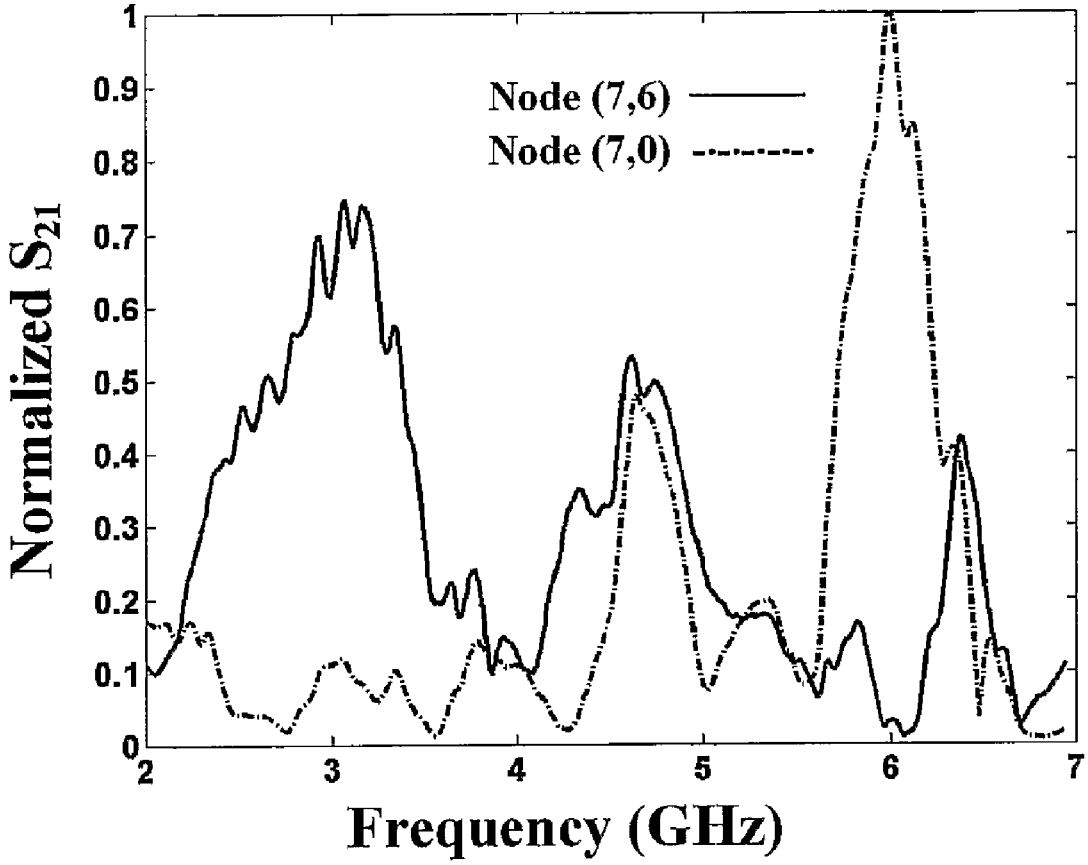
FIG. 24 shows: A plot of the S21 normalized to the 6 GHz peak at the output nodes of the harmonic splitter, showing the separated 3 GHz and 6 GHz modes.

The surface plots of the measured S21 (normalized to the S21 at node 0,0) are depicted in FIG. 23. The 3 GHz rectangular mode and the 6 GHz hyperbolic mode are separated at the central interface of the splitter and reach output nodes (7,6) and (7,0) respectively. To characterize the inter-channel isolation, the electric field intensities (normalized measured S21) on the output nodes (7,0), and (7,6) are plotted against frequency and are shown in FIG. 24. As shown in the figure, the two harmonic channels are well separated with an inter-channel isolation of 20 dB and 30 dB at the nodes (7,6) and (7,0) respectively, which are typical isolation values for microwave devices. The 3 GHz mode is characterized by higher bandwidth (lower quality factor or less selectivity) compared to the 6 GHz mode, which is consistent with the Brillouin diagram (FIG. 2). Auxiliary resonances at 4.75 GHz and 6.5 GHz are produced due to the imperfect terminations and can be suppressed by using better termination methods.

Figure 25:
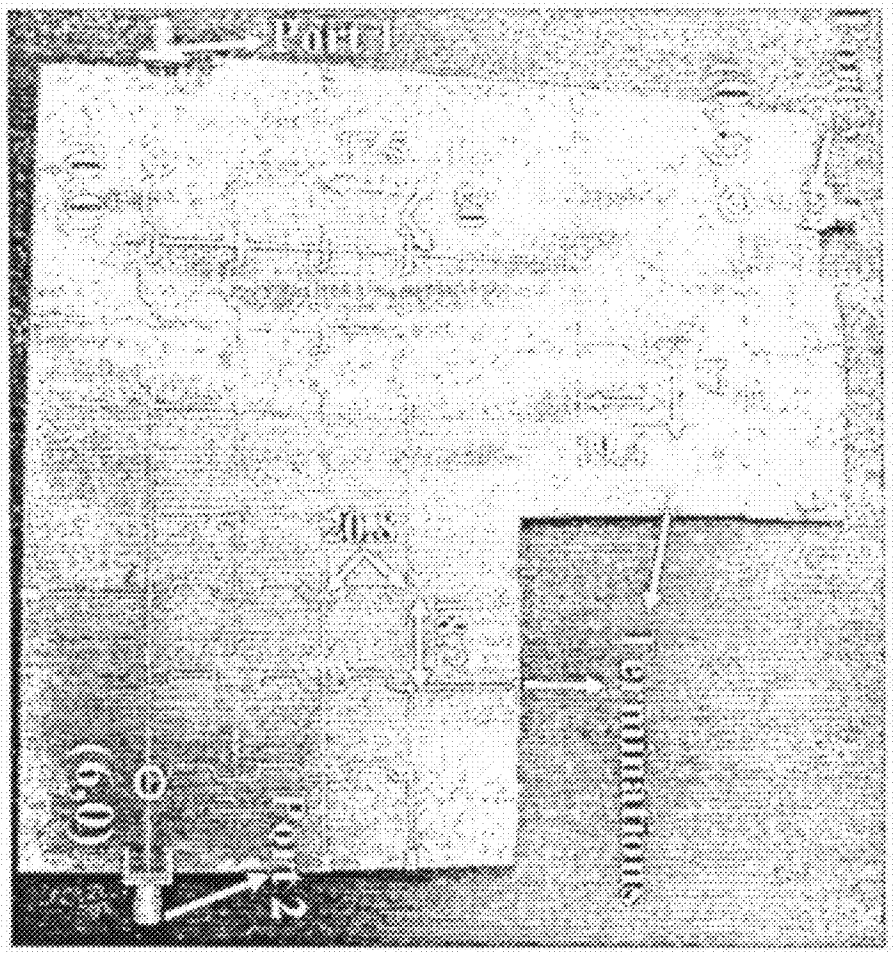
FIG. 25 shows: The photograph of the fabricated microstrip diplexer at a central frequency 6 GHz; All line widths are 0.6 mm, which corresponds to a characteristic impedance of 100 ohms; The input node (0,0) and output nodes (6,0), and (0,6) are marked by circles and the unit cell lengths are labelled in millimetres.

The fabricated microstrip version of the diplexer discussed in previous section is depicted in FIG. 25. The diplexer has been constructed using an RT/Duroid® 5880 substrate with relative permittivity 2.2 and height 0.787 mm. The lengths of the microstrip lines that form the three grids correspond to the phase angle scheme given in Table 3. The relative z-directed electric fields on the diplexer nodes are measured by employing the method described in the previous sub-section.

Figure 26:
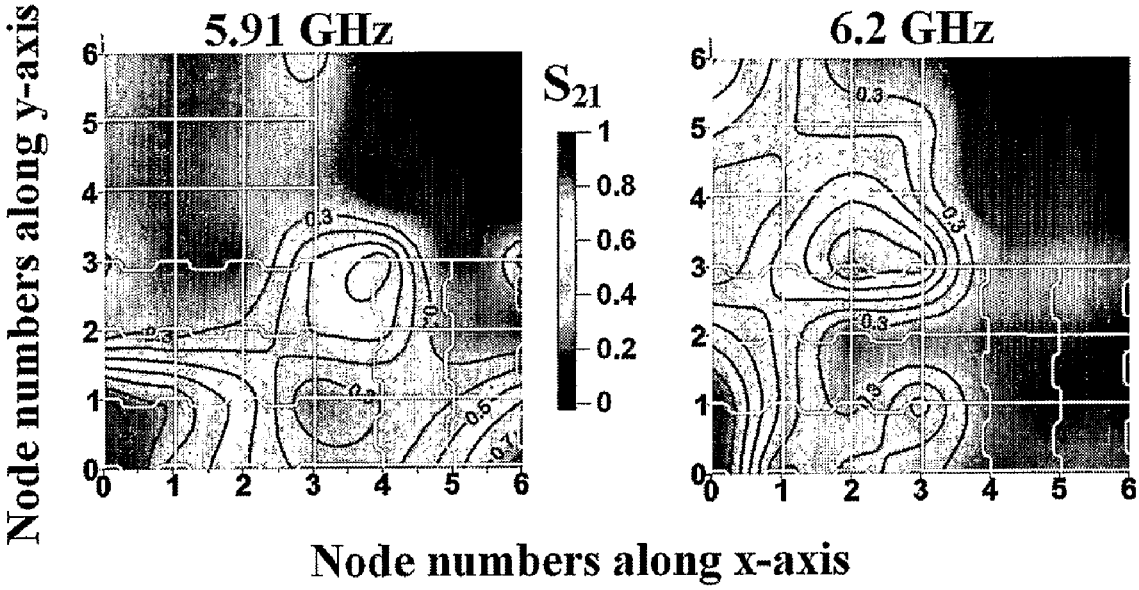
FIG. 26 shows: Surface intensity plots showing the normalized transmission coefficient S21 on the nodes of the microstrip diplexer, superimposed on the diplexer's schematic diagram.

The measured surface plots that show the relative field intensity (S21) on the diplexer nodes are given in FIG. 26. The 0.1 GHz shift in the diplexer lower channel frequency can be attributed mainly to the line-meandering in the splitter and tuner grids, which has not been taken into account while calculating the line lengths. The measured electric field distribution show that 5.9 GHz and 6.2 GHz channels split at the interface and arrive at nodes (6,0) and (0,6) of the diplexer. However, unlike the simulated results of FIG. 21, some inter-grid power leakage is also seen in the experimental field distribution plot, which mostly results from the termination method that employs off-the-shelf resistors that are soldered between the open-ended microstrip lines and the ground plane.

Figure 27:
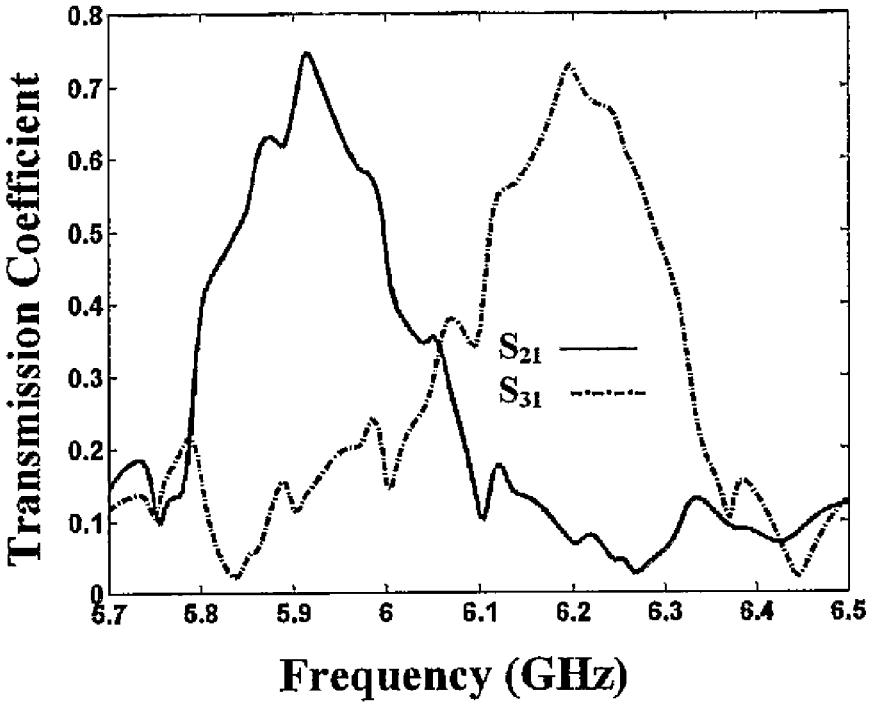
FIG. 27 shows: Simulation and measured transmission coefficients of the 6 GHz diplexer.
Figure 27:
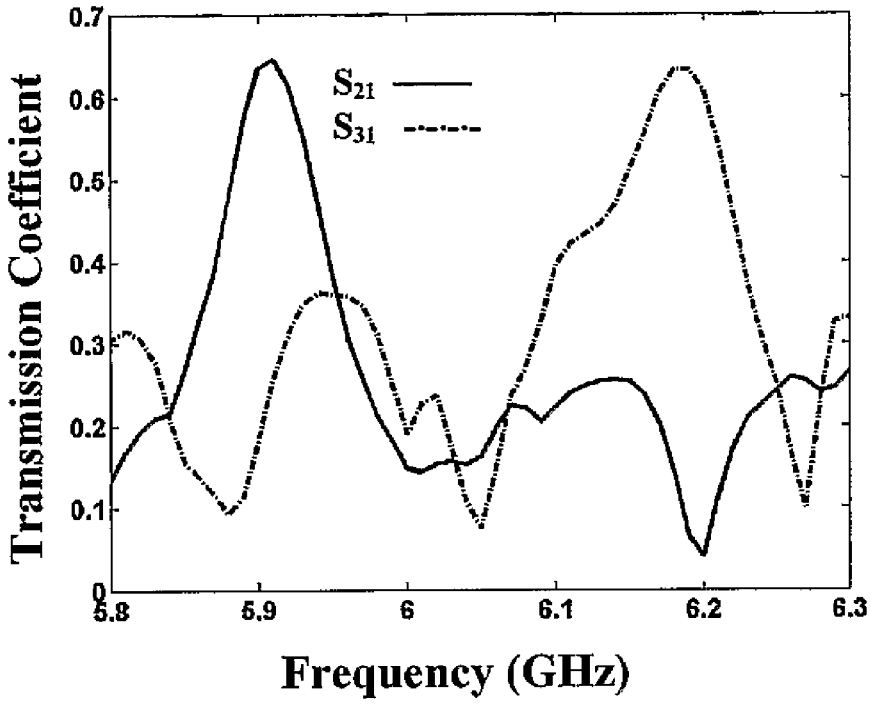
Figure 28:
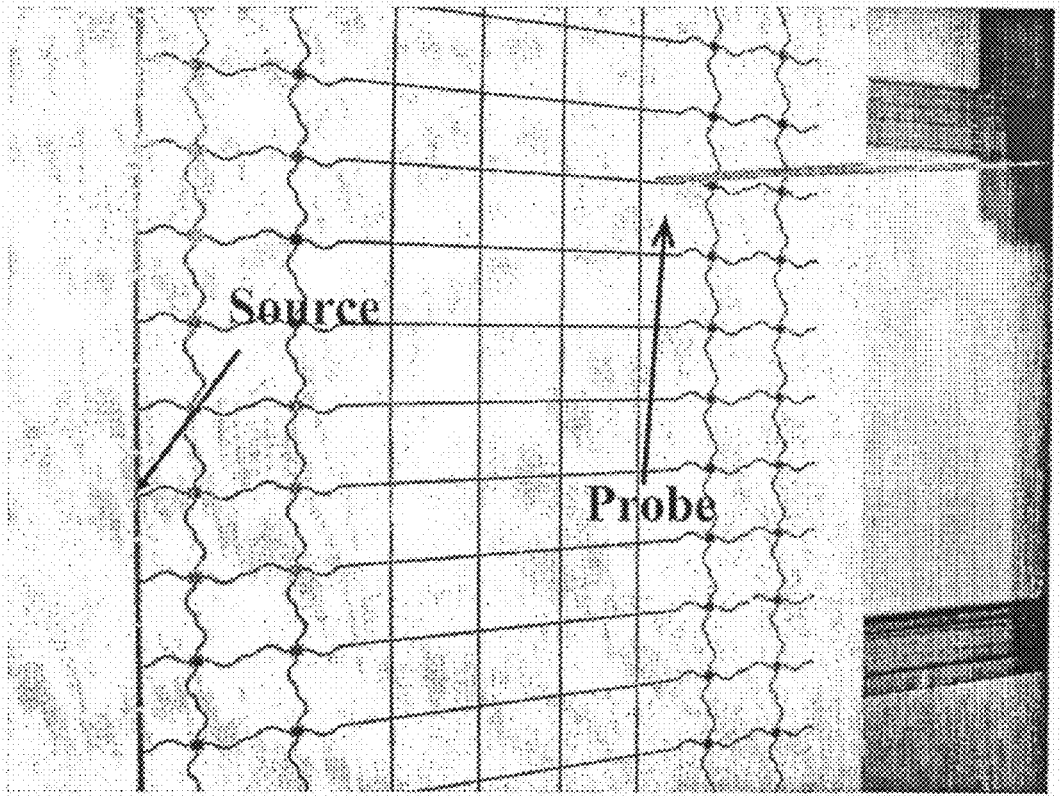
FIG. 28 shows: 4 columns of BWTL cells sandwiched between 2 columns of FWTL cells on either side, and excited at center of a 1-D dual TL feed on the left edge, as shown schematically (90 degree rotated) in FIG. 13.

Further characterization of the diplexer has been carried out by measuring the transmission coefficients at the output connectors with the help of an Agilent 5250 Vector Network Analyzer. For comparison, the simulated transmission coefficients are determined with the microwave circuit simulator Agilent ADS. The simulations and measurement results, given in FIG. 27, show good selectivity of the diplexer and its ability to separate closely spaced frequency channels. In both simulation and experiment, the output channels are separated by a frequency range that is approximately 5% of the center frequency of 6.05 GHz. The half-power channel bandwidth is about 2-2.5% in simulation and 1.2% in experiment. The insertion loss is about 4.0 dB for both the channels compared to 2 dB in simulation. The inter-channel power leakage causes relatively poor isolation of 12 dB on port 1, as compared to 15 dB in simulation. Port 2 exhibits better isolation of 15 dB, compared to 19 dB in simulation. Because of the periodic nature of the diplexer, the measurement results are very sensitive to the terminations. Additional insertion loss in measurement is in part due to the connectors used in the fabrication and the imperfect terminations. The measurement and simulation can be brought closer by employing a better termination scheme such as using coaxial loadings instead of soldered resistors. The overall design of the diplexer can be improved by reducing the conductor losses that primarily depend on physical properties of the substrate and the width of the microstrip lines. The isolation and the frequency separation can be arbitrarily designed by manipulating the design factors that include the relative sizes of the splitter and tuner grids that constitute the diplexer, the difference between the x- and y-directed unit cell phase shifts at resonance, and the microstrip transmission line parameters.

Continuous metallic grids over ground with rectangular unit cells can support dispersive modes that have rectangular and hyperbolic equi-frequency surfaces. As a consequence of their flat dispersion surfaces, the majority of the group velocity vectors in k-space become self-collimated producing sharp resonant beams that propagate in a specific direction, which is frequency dependent for the hyperbolic modes. The dispersion characteristics of the metallic grids can be manipulated to build interesting microwave and millimeter wave spatial filtering and multiplexing devices. For example, we have presented the design and simulation results of two such devices in this paper: a harmonic splitter that separates 3 GHz and its second harmonic and a diplexer that separates channels that are 5% apart with a center frequency of 6 GHz. Furthermore, the 3/6 GHz harmonic splitter and the 6 GHz diplexer have been fabricated using microstrip transmission lines and simulation and experimental results have been presented. Because of their unique dispersion properties, ease of fabrication, and scalability to higher frequencies, the proposed continuous metallic grids can be used to design many useful devices at microwave, millimetre-wave and Terahertz frequencies.

Although embodiments of the present invention have been described, those of skill in the art will appreciate that variations and modifications may be made without departing from the spirit and scope thereof as defined by the appended claims. For example, although only microstrip realizations have been described, other planar microwave transmission lines can be constructed to create negative-refraction metamaterials. These include stripline, coplanar strip, coplanar waveguide and their variations. Since no loading lumped elements are necessary, the same approach can be used to implement negative-refraction metamaterials from RF (radio frequencies) to terahertz and infrared frequencies. Moreover the same metamaterials could be implemented using dielectric thin film channel waveguides thus extending the realization of such metamaterials to optical frequencies.

What is claimed is:

1. An anisotropic hyperbolic planar metamaterial comprising:

a first set of substantially parallel, unloaded and coplanar transmission lines, said first set of transmission lines being spaced with a periodicity $d_y$;

a second set of substantially parallel, unloaded and coplanar transmission lines, said second set of transmission lines being spaced with a periodicity $d_x$, said second set of transmission lines further being coplanar and substantially orthogonal to said first set of transmission lines, wherein the periodicities of said first set and second set of transmission lines are governed by the relationship:

$$\beta_x(f_r)d_x+\beta_y(f_r)d_y=2\pi,$$

where:

$\beta_x$ and $\beta_y$ are the intrinsic propagation constants of electromagnetic waves of frequency $f_r$ propagating along the first and second set of transmission lines, respectively.

2. A material comprising a plurality of anisotropic hyperbolic planar metamaterials, each anisotropic hyperbolic planar metamaterial being in accordance with claim 1, wherein for at least two said metamaterials, those two said metamaterials have interchanged periodicities in x and y directions.

3. A method of refracting electromagnetic waves by employing a metamaterial according to claim 1.

4. A method of resonance cone focusing electromagnetic waves by employing a metamaterial according to claim 1.

5. The metamaterial of claim 1 wherein said first set of transmission lines is fabricated using microstrip technology.

6. The metamaterial of claim 5 wherein combined conductor losses and dielectric losses are minimized by selecting an optimum transmission line width corresponding to substrate thickness.

7. The metamaterial of claim 1 wherein said metamaterial supports rectangular dispersion of electromagnetic waves of at least one frequency $f_{rr}$ where $f_{rr}$ is not equal to $f_r$.

8. A harmonic splitter comprising:

at least two metamaterials, each metamaterial being in accordance with claim 7, said at least two metamaterials having mutually transposed periodicities d and being joined at an interface, an input port located at a corner of a first of said metamaterials which is opposite said interface, and two output ports at both corners of a second of said metamaterials which are opposite said interface.

9. A diplexer comprising:

a splitter metamaterial and at least first and second tuner metamaterials, each according to claim 1, wherein a product of periodicity and intrinsic propagation constant of the tuner metamaterials is mutually transposed with respect to the splitter metamaterial, and wherein the first and second tuner metamaterials have periodicities that support different resonant frequencies.

10. An isotropic planar metamaterial comprising:

a first set of substantially parallel, unloaded and coplanar transmission lines, said first set of transmission lines being spaced with a periodicity d;

a second set of substantially parallel, unloaded and coplanar said transmission lines, said second set of transmission lines being spaced with said periodicity d, said second set of transmission lines being coplanar and substantially orthogonal to said first set of transmission lines, the periodicity of said first set and second set of transmission lines being governed by the relationships:

$$d=\lambda-\delta \text{ and } \beta=2\pi/\lambda$$

where:

$\beta$ is the intrinsic propagation constant of electromagnetic waves of wavelengths $\lambda$ on the transmission lines and $\delta$ is a differential length such that $\delta<\lambda/2$.

* * * * *